US010635013B2

(12) United States Patent
Ishino et al.

(10) Patent No.: US 10,635,013 B2
(45) **Date of Patent: *Apr. 28, 2020**

(54) IMAGE FORMING APPARATUS AND IMAGE FORMING METHOD

(71) Applicant: KYOCERA Document Solutions Inc., Osaka (JP)

(72) Inventors: Masahito Ishino, Osaka (JP); Nariaki Tanaka, Osaka (JP); Toshiki Fujita, Osaka (JP); Teppei Shibuya, Osaka (JP); Kiyotaka Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/505,896

(22) Filed: Jul. 9, 2019

(65) Prior Publication Data

US 2020/0041923 A1 Feb. 6, 2020

(30) Foreign Application Priority Data

Jul. 31, 2018 (JP) ..... 2018-143066

(51) Int. Cl.

| | |
|---|---|
| ***G03G 15/00*** | (2006.01) |
| ***G03G 15/02*** | (2006.01) |
| ***G03G 21/00*** | (2006.01) |
| ***G03G 21/16*** | (2006.01) |
| ***G03G 15/16*** | (2006.01) |
| ***G03G 5/05*** | (2006.01) |
| ***G03G 5/06*** | (2006.01) |

(52) U.S. Cl.

CPC ..... *G03G 15/0258* (2013.01); *G03G 5/0546* (2013.01); *G03G 5/0609* (2013.01); *G03G 5/0614* (2013.01); *G03G 15/167* (2013.01); *G03G 21/0005* (2013.01); *G03G 21/169* (2013.01)

(58) Field of Classification Search

CPC ..... G03G 15/0258; G03G 15/167; G03G 5/0546; G03G 5/0609; G03G 5/0614

USPC ..... 430/119.71

See application file for complete search history.

(56) References Cited

FOREIGN PATENT DOCUMENTS

JP 2000-075752 A 3/2000

*Primary Examiner* — Mark A Chapman

(74) *Attorney, Agent, or Firm* — Studebaker & Brackett PC

(57) ABSTRACT

An image forming apparatus includes an image bearing member, a charger, and a cleaning member. The charger charges a circumferential surface of the image bearing member to a positive polarity. The cleaning member is pressed against the circumferential surface of the image bearing member and collects a toner remaining on the circumferential surface of the image bearing member. A linear pressure N of the cleaning member on the circumferential surface of the image bearing member is at least 14 N/m and no greater than 40 N/m. A rebound resilience R of the cleaning member at a temperature of 25° C. is at least 38%. The leaner pressure N and the rebound resilience R satisfy mathematical formula (1A). The image bearing member satisfies mathematical formula (1B).

$$R < 13.771 \times N^{0.4043} \quad (1A)$$

$$0.60 \leqq \frac{V}{(Q/S) \times (d/\varepsilon_r \cdot \varepsilon_0)} \quad (1B)$$

14 Claims, 14 Drawing Sheets

IMAGE FORMING APPARATUS AND IMAGE FORMING METHOD

INCORPORATION BY REFERENCE

The present application claims priority under 35 U.S.C. § 119 to Japanese Patent Application No. 2018-143066, filed on Jul. 31, 2018. The contents of this application are incorporated herein by reference in their entirety.

BACKGROUND

The present disclosure relates to an image forming apparatus and an image forming method.

An electrophotographic image forming apparatus collects toner remaining on a circumferential surface of an image bearing member therein using a cleaning member (for example, a cleaning blade). In order to form high-definition images, it is desirable to use a toner having a small particle diameter and a high roundness. However, such a toner easily passes through a gap between a cleaning member and a circumferential surface of an image bearing member, tending to cause insufficient cleaning. In order to prevent insufficient cleaning, for example, it has been contemplated to tightly press the cleaning member against the image bearing member. However, the cleaning member tightly pressed against the image bearing member rubs hard on the circumferential surface of the image bearing member, and as a result some failure may occur in the image bearing member.

In order to reduce friction force between the cleaning member and the circumferential surface of the image bearing member, for example, it has been contemplated to apply a lubricant to the image bearing member. For example, an image forming apparatus has been known that includes a lubricant application mechanism located upstream of an image bearing member cleaning means.

SUMMARY

An image forming apparatus according to an aspect of the present disclosure includes an image bearing member, a charger, and a cleaning member. The charger charges a circumferential surface of the image bearing member to a positive polarity. The cleaning member is pressed against the circumferential surface of the image bearing member and collects a toner remaining on the circumferential surface of the image bearing member. A linear pressure N of the cleaning member on the circumferential surface of the image bearing member is at least 14 N/m and no greater than 40 N/m. A rebound resilience R of the cleaning member at a temperature of 25° C. is at least 38%. The linear pressure N and the rebound resilience R satisfy mathematical formula (1A). The image bearing member includes a conductive substrate and a single-layer photosensitive layer. The single-layer photosensitive layer contains a charge generating material, a hole transport material, an electron transport material, and a binder resin. The image bearing member satisfies mathematical formula (1B).

$$R < 13.771 \times N^{0.4043} \quad (1A)$$

$$0.60 \leqq \frac{V}{(Q/S) \times (d/\varepsilon_r \cdot \varepsilon_0)} \quad (1B)$$

In mathematical formula (1B), Q represents a charge amount of the image bearing member. S represents a charge area of the image bearing member. d represents a film thickness of the single-layer photosensitive layer. $\varepsilon_r$ represents a specific permittivity of the binder resin contained in the single-layer photosensitive layer. $\varepsilon_0$ represents a vacuum permittivity. V is a value calculated in accordance with the following expression: $V=V_0-V_r$. $V_r$ represents a first potential of the circumferential surface of the image bearing member yet to be charged by the charger. $V_0$ represents a second potential of the circumferential surface of the image bearing member charged by the charger.

A method for forming an image according to another aspect of the present disclosure includes charging a circumferential surface of an image bearing member to a positive polarity and collecting a toner remaining on the circumferential surface of the image bearing member through a cleaning member being pressed against the circumferential surface of the image bearing member. A linear pressure N of the cleaning member on the circumferential surface of the image bearing member is at least 14 N/m and no greater than 40 N/m. A rebound resilience R of the cleaning member at a temperature of 25° C. is at least 38%. The linear pressure N and the rebound resilience R satisfy mathematical formula (1A). The image bearing member includes a conductive substrate and a single-layer photosensitive layer. The single-layer photosensitive layer contains a charge generating material, a hole transport material, an electron transport material, and a binder resin. The image bearing member satisfies mathematical formula (1B).

$$R < 13.771 \times N^{0.4043} \quad (1A)$$

$$0.60 \leqq \frac{V}{(Q/S) \times (d/\varepsilon_r \cdot \varepsilon_0)} \quad (1B)$$

In mathematical formula (1B), Q represents a charge amount of the image bearing member. S represents a charge area of the image bearing member. d represents a film thickness of the single-layer photosensitive layer. $\varepsilon_r$ represents a specific permittivity of the binder resin contained in the single-layer photosensitive layer. $\varepsilon_0$ represents a vacuum permittivity. V is a value calculated in accordance with the following expression: $V=V_0-V_r$. $V_r$ represents a first potential of the circumferential surface of the image bearing member yet to be charged by the charger. $V_0$ represents a second potential of the circumferential surface of the image bearing member charged by the charger.

DETAILED DESCRIPTION

Figure 1:
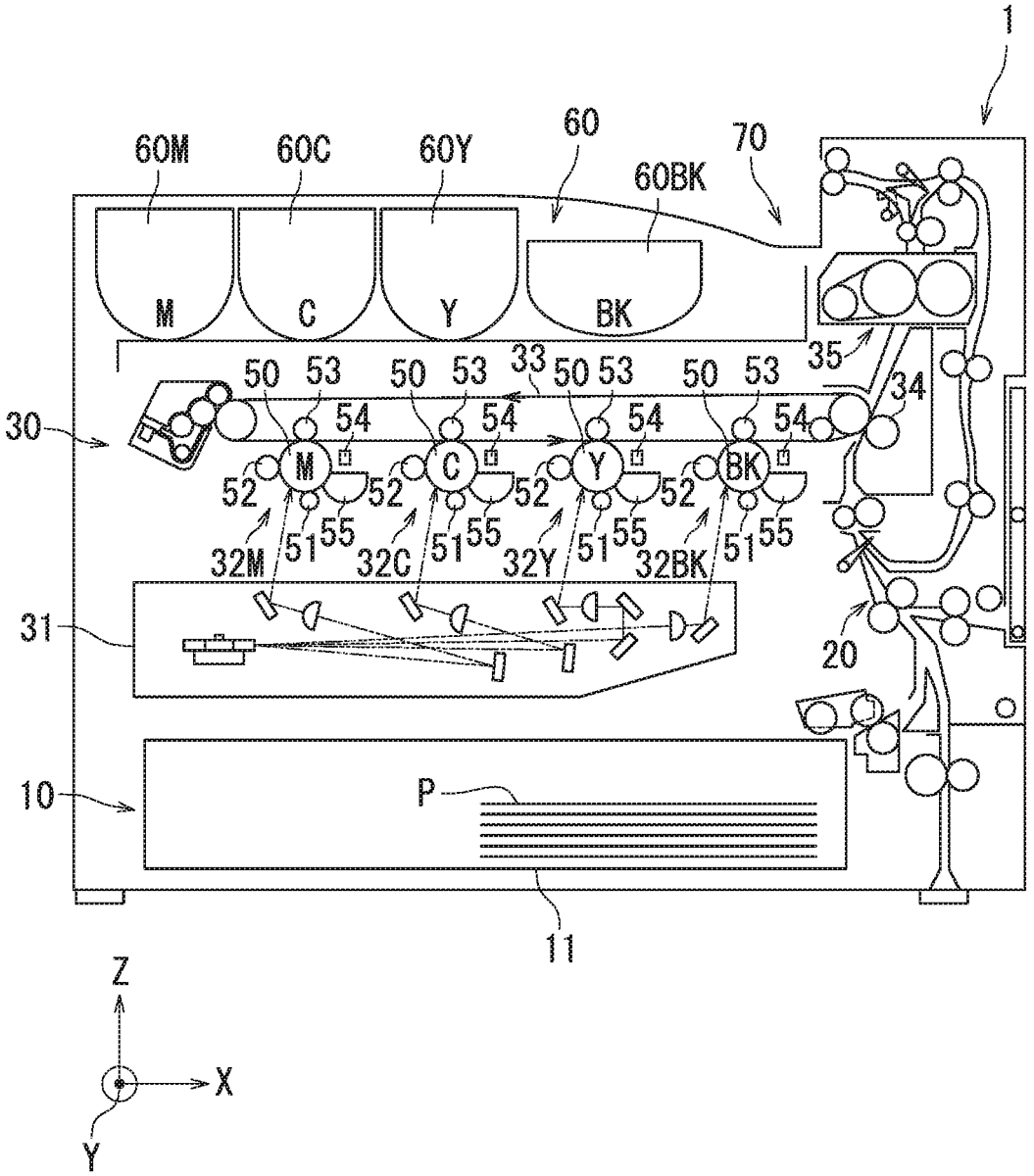
FIG. 1 is a cross-sectional view of an image forming apparatus according to a first embodiment of the present disclosure.

The following first describes terms used in the present specification. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, and an alkoxy group having a carbon number of at least 1 and no greater than 4 each refer to the following, unless otherwise stated.

Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein each refer to an unsubstituted straight chain or branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 6 are examples of the alkyl group having a carbon number of at least 1 and no greater than 6, the chemical groups having a carbon number of at least 1 and no greater than 5 are examples of the alkyl group having a carbon number of at least 1 and no greater than 5, the chemical groups having a carbon number of at least 1 and no greater than 4 are examples of the alkyl group having a carbon number of at least 1 and no greater than 4, and the chemical groups having a carbon number of at least 1 and no greater than 3 are examples of the alkyl group having a carbon number of at least 1 and no greater than 3.

An alkoxy group having a carbon number of at least 1 and no greater than 4 as used herein refers to an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group. Through the above, terms used in the present specification have been described.

Image Forming Apparatus According to First Embodiment

The following describes a first embodiment of the present disclosure with reference to the accompanying drawings. Elements in the drawings that are the same or equivalent are marked by the same reference signs and description thereof is not repeated. In the first embodiment, an X axis, a Y axis, and a Z axis are perpendicular to one another. The X axis and the Y axis are parallel with a horizontal plane, and the Z axis is parallel with a vertical line.

The following first describes an overview of an image forming apparatus 1 according to the first embodiment with reference to FIG. 1. The image forming apparatus 1 according to the first embodiment is a full-color printer. The image forming apparatus 1 includes a feed section 10, a conveyance section 20, an image forming section 30, a toner supply section 60, and an ejection section 70.

The feed section 10 includes a cassette 11 that accommodates a plurality of sheets P. The feed section 10 feeds a sheet P from the cassette 11 to the conveyance section 20. The sheet P is for example a paper sheet or a synthetic resin sheet. The conveyance section 20 conveys the sheet P to the image forming section 30.

The image forming section 30 includes a light exposure device 31, a magenta unit (referred to below as an M unit) 32M, a cyan unit (referred to below as a C unit) 32C, a yellow unit (referred to below as a Y unit) 32Y, a black unit (referred to below as a BK unit) 32BK, a transfer belt 33, a secondary transfer roller 34, and a fixing device 35. The M unit 32M, the C unit 32C, the Y unit 32Y, and the BK unit 32BK each include a photosensitive member 50, a charging roller 51, a development roller 52, a primary transfer roller 53, a static elimination lamp 54, and a cleaner 55.

The light exposure device 31 irradiates each of the M unit 32M, the C unit 32C, the Y unit 32Y, and the BK unit 32BK with light to form an electrostatic latent image in each of the M unit 32M, the C unit 32C, the Y unit 32Y, and the BK unit 32BK. The M unit 32M forms a magenta toner image based on the electrostatic latent image. The C unit 32C forms a cyan toner image based on the electrostatic latent image. The Y unit 32Y forms a yellow toner image based on the electrostatic latent image. The BK unit 32BK forms a black toner image based on the electrostatic latent image.

Each photosensitive member 50 is drum-shaped. The photosensitive member 50 rotates about a rotation center 50X (a rotational axis, see FIG. 2). The charging roller 51, the development roller 52, the primary transfer roller 53, the static elimination lamp 54, and the cleaner 55 are located around the photosensitive member 50 in the stated order from upstream in a rotation direction r (see FIG. 2) of the photosensitive member 50. The charging roller 51 charges a circumferential surface 50*a* of the photosensitive member 50 to a positive polarity. As already described, the light exposure device 31 irradiates the charged circumferential surface 50*a* of the photosensitive member 50 with light to form an electrostatic latent image on the circumferential surface 50*a* of the photosensitive member 50. The development roller 52 carries a carrier CA supporting a toner T thereon by attracting the carrier CA thereto by magnetic force. A development bias (a development voltage) is applied to the development roller 52 to generate a difference between a potential of the development roller 52 and a potential of the circumferential surface 50*a* of the photosensitive member 50. As a result, the toner T moves and adheres to the electrostatic latent image formed on the circumferential surface 50*a* of the photosensitive member 50. As described above, the development roller 52 supplies the toner T to the electrostatic latent image to develop the electrostatic latent image into a toner image. Thus, the toner image is formed on the circumferential surface 50*a* of the photosensitive member 50. The toner image includes the toner T. The transfer belt 33 is in contact with the circumferential surface 50*a* of the photosensitive member 50. The primary transfer roller 53 performs primary transfer of the toner image from the circumferential surface 50*a* of the photosensitive member 50 to the transfer belt 33 (more specifically, an outer surface of the transfer belt 33). Through the primary transfer by the primary transfer rollers 53, toner images of the four colors are superimposed on one another on the outer surface of the transfer belt 33. The toner images of the four colors are a magenta toner image, a cyan toner image, a yellow toner image, and a black toner image. A color toner image is formed on the outer surface of the transfer belt 33 through the primary transfer. The secondary transfer roller 34 performs secondary transfer of the color toner image from the outer surface of the transfer belt 33 to the sheet P. The fixing device 35 applies heat and pressure to the sheet P to fix the color toner image to the sheet P. The sheet P with the color toner image fixed thereto is ejected by the ejection section 70. After the primary transfer, the static elimination lamp 54 in each of the M unit 32M, the C unit 32C, the Y unit 32Y, and the BK unit 32BK eliminates static electricity from the circumferential surface 50*a* of the corresponding photosensitive member 50. After the primary transfer (more specifically, after the primary transfer and the static elimination), the cleaner 55 collects residual toner T on the circumferential surface 50*a* of the photosensitive member 50.

The toner supply section 60 includes a cartridge 60M containing a magenta toner T, a cartridge 60C containing a cyan toner T, a cartridge 60Y containing a yellow toner T, and a cartridge 60BK containing a black toner T. The cartridge 60M, the cartridge 60C, the cartridge 60Y, and the cartridge 60BK respectively supply the toners T to the development rollers 52 of the M unit 32M, the C unit 32C, the Y unit 32Y, and the BK unit 32BK.

Note that the photosensitive member 50 is equivalent to what may be referred to as an image bearing member. The charging roller 51 is equivalent to what may be referred to as a charger. The development roller 52 is equivalent to what may be referred to as a development device. The primary transfer roller 53 is equivalent to what may be referred to as a transfer device. The transfer belt 33 is equivalent to what may be referred to as a transfer target. The static elimination lamp 54 is equivalent to what may be referred to as a static elimination device. The cleaner 55 is equivalent to what may be referred to as a cleaning device.

Figure 2:
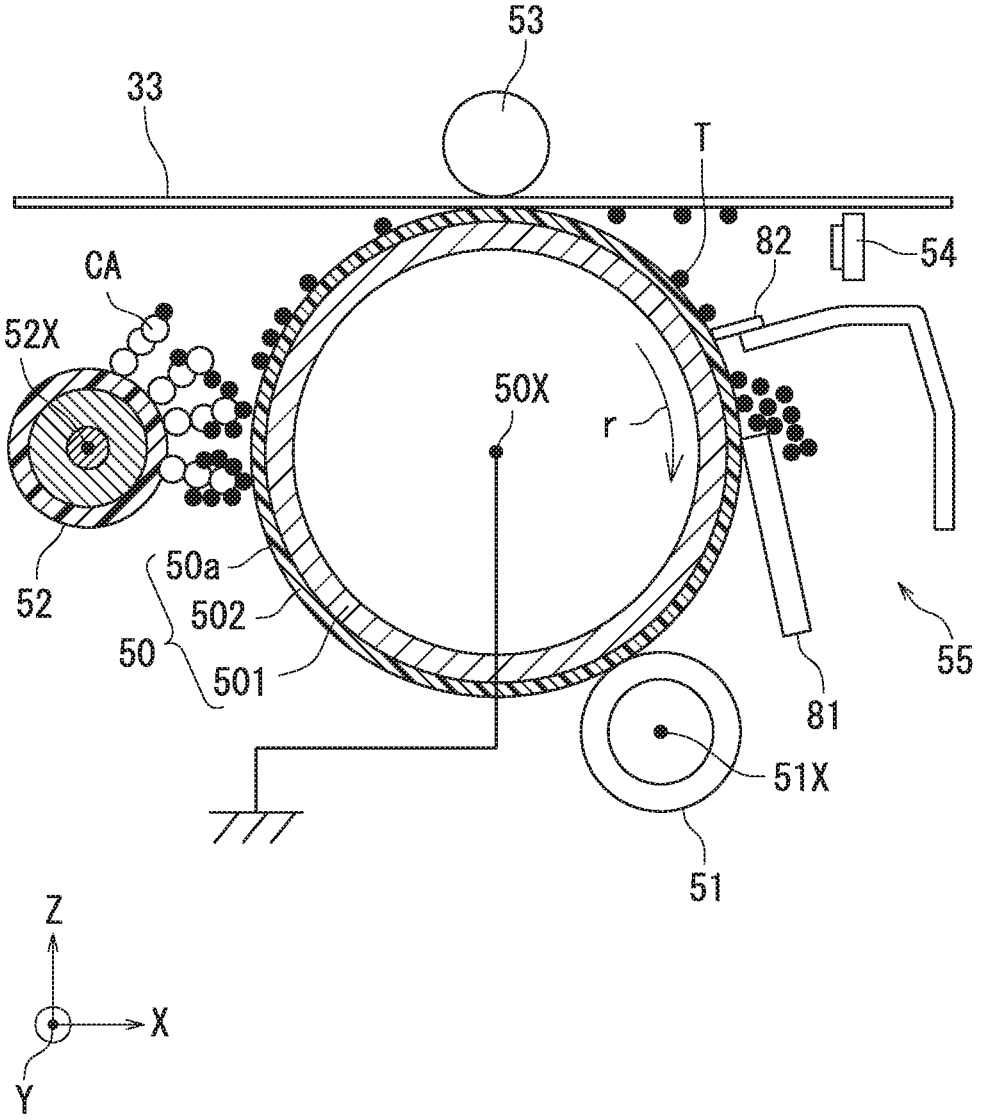
FIG. 2 is a diagram illustrating a photosensitive member included in the image forming apparatus illustrated in FIG. 1 and elements around the photosensitive member.

The following further describes the image forming apparatus 1 according to the first embodiment with reference to FIG. 2. FIG. 2 illustrates the photosensitive member 50 and elements around the photosensitive member 50. The image forming apparatus 1 according to the first embodiment includes the photosensitive members 50, each of which is equivalent to the image bearing member, the charging rollers 51, each of which is equivalent to the charger, and the cleaners 55. Each cleaner 55 includes a cleaning blade 81, which is equivalent to what may be referred to as a cleaning member. Each charging roller 51 charges the circumferential surface 50*a* of the corresponding photosensitive member 50 to a positive polarity. The cleaning blade 81 is pressed against the circumferential surface 50*a* of the photosensitive member 50 and collects residual toner T on the circumferential surface 50*a* of the photosensitive member 50.

In the case of a toner T having a small particle diameter and a high roundness, the toner T easily passes through a gap between the cleaning blade 81 and the circumferential surface 50*a* of the photosensitive member 50, tending to cause insufficient cleaning. In view of the foregoing, therefore, a linear pressure N of the cleaning blades 81 on the circumferential surfaces 50*a* of the respective photosensitive members 50 is set to at least 14 N/m and no greater than 40 N/m in order to prevent insufficient cleaning in the image forming apparatus 1 according to the first embodiment. As a result of each cleaning blade 81 being tightly pressed against the corresponding photosensitive member 50 at a linear pressure N in the above-specified range, it is possible to eliminate or extremely reduce the gap between the cleaning blade 81 and the circumferential surface 50*a* of the photosensitive member 50. It is therefore possible to prevent insufficient cleaning on the circumferential surface 50*a* of the photosensitive member 50 even if a toner T having a small particle diameter and a high roundness is used.

However, the present inventors' study has revealed that a higher linear pressure N (for example a linear pressure N of at least 14 N/m and no greater than 40 N/m) of the cleaning blade 81 on the circumferential surface 50*a* of the photosensitive member 50 is more likely to lead to occurrence of a ghost image. The ghost image refers to a phenomenon described as appearance of a residual image along with an output image (an image formed on a sheet P), which in other words is reappearance of an image formed during a previous rotation of the photosensitive member 50. A ghost image for example occurs due to non-uniform charging of the circumferential surface 50*a* of the photosensitive member 50, which may be caused by a change in charge injection to a photosensitive layer 502 of the photosensitive member 50, residual charge present within the photosensitive layer 502, or flow of current made non-uniform during image transfer depending on presence or absence of a toner image on the photosensitive layer 502.

The present inventors' study has also revealed that occurrence of a ghost image is more significant in the case of the photosensitive member 50 having the photosensitive layer 502, which is a single-layer photosensitive layer, than in the case of a photosensitive member having a multi-layer photosensitive layer. The single-layer photosensitive layer 502 is relatively thick. The thicker the photosensitive layer 502 is, the more easily electrons and holes generated from a charge generating material are trapped by residual charge in the photosensitive layer 502. The trapped electrons and holes prevent the photosensitive member 50 from being uniformly charged, causing a ghost image.

The present inventors therefore made intensive study on the photosensitive member 50 capable of inhibiting occurrence of a ghost image even if the linear pressure N of the cleaning blade 81 on the circumferential surface 51*a* of the photosensitive member 50 is high (for example, a linear pressure N of at least 14 N/m and no greater than 40 N/m) and the photosensitive member 50 has the single-layer photosensitive layer 502. The present inventors then found that occurrence of a ghost image can be inhibited as long as the photosensitive member 50 satisfies mathematical formula (1B) shown below, even if the linear pressure N of the cleaning blade 81 is at least 14 N/m and no greater than 40 N/m, and the photosensitive member 50 has the single-layer photosensitive layer 502.

Furthermore, in order to prevent insufficient cleaning, the rebound resilience R of the cleaning blade 81 is set to at least 38% in the image forming apparatus 1 according to the first embodiment. However, the present inventors' study had revealed that a prime mark shaped streak (also referred to below as "a dash mark") tends to often occur with an increase in rebound resilience R of the cleaning blade 81. The present inventors accordingly made intensive study to find that when mathematical formula (1A) shown below in addition to mathematical formula (1B) is satisfied can inhibit occurrence of a dash mark even in the case of the cleaning blade 81 having a high rebound resilience R (for example, at least 38%). From the above, the image forming apparatus according to the first embodiment can inhibit occurrence of a ghost image, prevent insufficient cleaning, and inhibit occurrence of a dash mark.

<Photosensitive Member>

Figure 3:
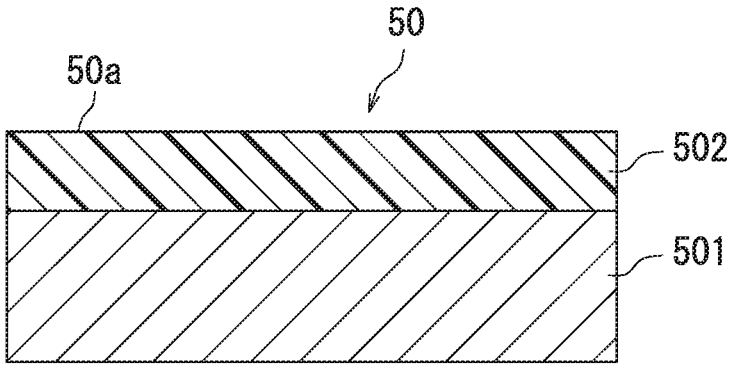
FIG. 3 is a partial cross-sectional view of an example of the photosensitive member included in the image forming apparatus illustrated in FIG. 1.
Figure 4:
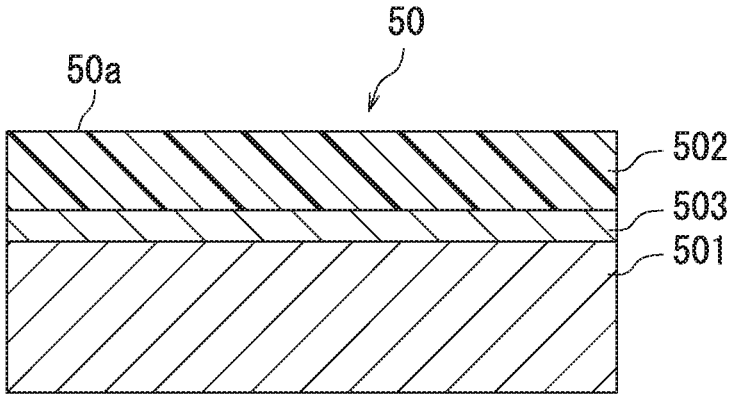
FIG. 4 is a partial cross-sectional view of an example of the photosensitive member included in the image forming apparatus illustrated in FIG. 1.
Figure 5:
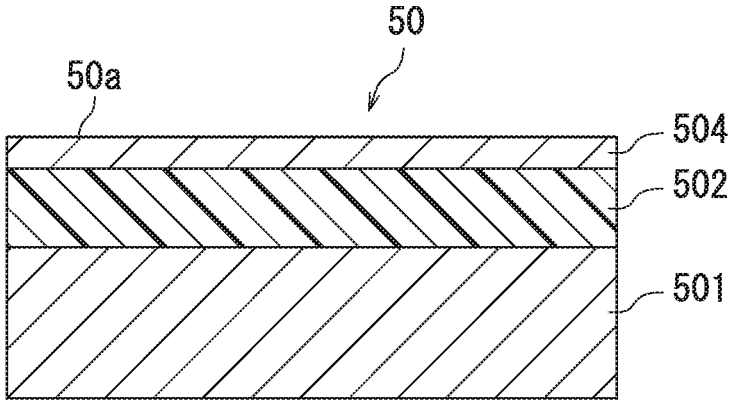
FIG. 5 is a partial cross-sectional view of an example of the photosensitive member included in the image forming apparatus illustrated in FIG. 1.

The following describes the photosensitive member 50 of the image forming apparatus 1 with reference to FIGS. 3 to 5. FIGS. 3 to 5 are each a partial cross-sectional view of an example of the photosensitive member 50. The photosensitive member 50 is for example an organic photoconductor (OPC) drum.

As illustrated in FIG. 3, the photosensitive member 50 for example includes a conductive substrate 501 and the photosensitive layer 502. The photosensitive layer 502 is a single-layer (one-layer) photosensitive layer. The photosensitive member 50 is a single-layer electrophotographic photosensitive member including the single-layer photosensitive layer 502. The photosensitive layer 502 contains a charge generating material, a hole transport material, an electron transport material, and a binder resin. No particular limitations are placed on the film thickness of the photosensitive layer 502. The photosensitive layer 502 preferably has a film thickness of at least 5 μm and no greater than 100 μm, more preferably at least 10 μm and no greater than 50 μm, still more preferably at least 10 μm and no greater than 35 μm, and further preferably at least 15 μm and no greater than 30 μm.

The photosensitive member 50 may include an intermediate layer 503 (an undercoat layer) as well as the conductive substrate 501 and the photosensitive layer 502 as illustrated in FIG. 4. The intermediate layer 503 is disposed between the conductive substrate 501 and the photosensitive layer 502. The photosensitive layer 502 may be disposed directly on the conductive substrate 501 as illustrated in FIG. 3. Alternatively, the photosensitive layer 502 may be disposed indirectly on the conductive substrate 501 with the intermediate layer 503 therebetween as illustrated in FIG. 4. The intermediate layer 503 may be a single-layer intermediate layer or a multi-layer intermediate layer.

The photosensitive member 50 may include a protective layer 504 as well as the conductive substrate 501 and the photosensitive layer 502 as illustrated in FIG. 5. The protective layer 504 is disposed on the photosensitive layer 502. The protective layer 504 may be a single-layer protective layer or a multi-layer protective layer.

(Chargeability Ratio)

The photosensitive member 50 satisfies mathematical formula (1B) shown below.

$$0.60 \leqq \frac{V}{(Q/S)\times(d/\varepsilon_r\cdot\varepsilon_0)} \tag{1B}$$

In mathematical formula (1B), Q represents a charge amount (unit: C) of the photosensitive member 50. S represents a charge area (unit: $m^2$) of the photosensitive member 50. d represents a film thickness (unit: m) of the photosensitive layer 502 of the photosensitive member 50. $\varepsilon_r$ represents a specific permittivity of a binder resin contained in the photosensitive layer 502 of the photosensitive member 50. $\varepsilon_0$ represents a vacuum permittivity (unit: F/m). Note that "$d/\varepsilon_r\cdot\varepsilon_0$" means "$d/(\varepsilon_r\times\varepsilon_0)$". V is a value calculated in accordance with expression (2) shown below.

$$V=V_0-V_r \tag{2}$$

$V_r$ in expression (2) represents a first potential of the circumferential surface 50*a* of the photosensitive member 50 yet to be charged by the charging roller 51. $V_0$ in expression (2) represents a second potential of the circumferential surface 50*a* of the photosensitive member 50 charged by the charging roller 51.

A value represented by mathematical formula (1B') in mathematical formula (1B) is also referred to below as a chargeability ratio. The chargeability ratio represented by mathematical formula (1B') is a ratio of actual chargeability (measured value) of the photosensitive member 50 to theoretical chargeability (theoretical value) of the photosensitive member 50 when the circumferential surface 50*a* of the photosensitive member 50 is charged by the charging roller 51. The ratio of actual chargeability of the photosensitive member 50 to theoretical chargeability of the photosensitive member 50 will be described later in detail with reference to FIG. 7.

$$\frac{V}{(Q/S)\times(d/\varepsilon_r\cdot\varepsilon_0)} \tag{1B'}$$

The photosensitive member 50 satisfying mathematical formula (1B) offers the following first to third advantages.

The following describes the first advantage. As already described, a higher linear pressure N (for example, a linear pressure N of at least 14 N/m and no greater than 40 N/m) of the cleaning blade 81 on the circumferential surface 50*a* of the photosensitive member 50 is more likely to lead to occurrence of a ghost image. However, as long as the photosensitive member 50 satisfies mathematical formula (1B), chargeability of the photosensitive member 50 is close enough to the theoretical value thereof, and therefore the circumferential surface 50*a* of the photosensitive member 50 can be uniformly charged. It is therefore possible to inhibit occurrence of a ghost image even if the linear pressure N of the cleaning blade 81 is at least 14 N/m and no greater than 40 N/m.

The following describes the second advantage. The photosensitive layer 502 of the photosensitive member 50 may abrade away in the course of repeated image formation. The photosensitive layer 502 abrades away for example due to electrical discharge from the charging roller 51 to the photosensitive member 50. As long as the photosensitive member 50 satisfies mathematical formula (1B), chargeability of the photosensitive member 50 is close enough to the theoretical value thereof, and therefore the circumferential surface 50*a* of the photosensitive member 50 can be adequately charged even if a set amount of electrical discharge from the charging roller 51 to the photosensitive member 50 is low. As a result of the amount of the electrical discharge being low, it is possible to reduce an amount of abrasion of the photosensitive layer 502. Furthermore, as a result of the amount of abrasion of the photosensitive layer 502 being reduced, it is possible to set a small film thickness for the photosensitive layer 502, reducing manufacturing costs.

The following describes the third advantage. As long as the photosensitive member 50 satisfies mathematical formula (1B), chargeability of the photosensitive member 50 is close enough to the theoretical value thereof, and therefore the circumferential surface 50*a* of the photosensitive member 50 can be adequately charged even if a set value of current flowing through the charging roller 51 is low. As a result of the current flowing through the charging roller 51 being low, it is possible to prevent conductivity of a material (for example, rubber) of the charging roller 51 from decreasing due to energization. As described as the first advantage, it is possible to inhibit occurrence of a ghost image even if the linear pressure N of the cleaning blade 81 is high (at least 14 N/m and no greater than 40 N/m) as long as the photosensitive member 50 satisfies mathematical formula (1B). Since the linear pressure N can be high, an additive of the toner T is prevented from easily passing through the gap between the cleaning blade 81 and the circumferential surface 50*a* of the photosensitive member 50. As a result of the additive being prevented from easily passing through the gap, an external additive is prevented from easily adhering to a surface of the charging roller 51. Since the conductivity of the material of the charging roller 51 can be prevented from decreasing, and the external additive is prevented from easily adhering to the surface of the charging roller 51, it is possible to prevent elevation of resistance of the charging roller 51.

In order to inhibit occurrence of a ghost image, the chargeability ratio in mathematical formula (1B) is preferably at least 0.70, more preferably at least 0.80, and still more preferably at least 0.90. The measured value of chargeability of the photosensitive member 50 is equal to the theoretical value thereof when the chargeability ratio is 1.00. That is, the chargeability ratio is no greater than 1.00.

The following describes a method for measuring the chargeability ratio. V in mathematical formula (1B) is a value calculated in accordance with expression (2) shown above. The following describes a method for measuring a first potential $V_r$ and a second potential $V_0$ in expression (2) with reference to FIG. 6. The first potential $V_r$ and the second potential $V_0$ are measured under environmental conditions of a temperature of 23° C. and a relative humidity of 50%.

Figure 6:
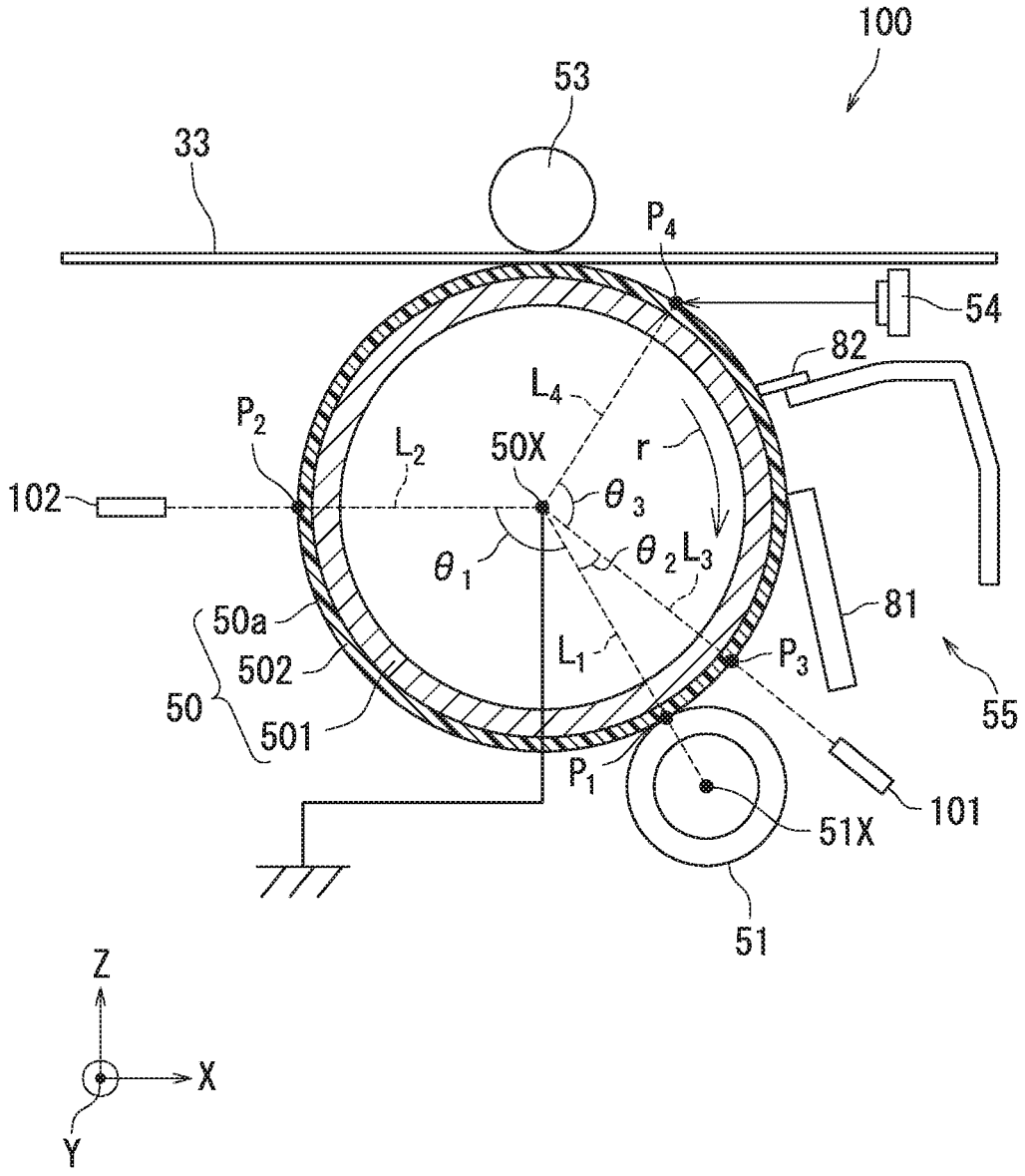
FIG. 6 is a diagram illustrating a measuring device for measuring a first potential $V_r$ and a second potential $V_0$.

The first potential $V_r$ and the second potential $V_0$ are measured using a measuring device 100 illustrated in FIG. 6. The measuring device 100 can be prepared by making a first modification and a second modification to the image forming apparatus 1. As the first modification, a first voltage probe 101 is attached to the image forming apparatus 1. The first voltage probe 101 is located upstream of a charging roller 51 in a rotation direction r of the photosensitive member 50. The first voltage probe 101 is connected to a first surface electrometer ("MODEL 344 ELECTROSTATIC VOLTMETER", product of TREK, INC., not shown). As the second modification, a development roller 52 of the image forming apparatus 1 is replaced with a second voltage probe 102. The second voltage probe 102 is disposed in a position where a rotation center 52X (a rotational axis) of the development roller 52 is previously located. The second voltage probe 102 is connected to a second surface electrometer ("MODEL 344 ELECTROSTATIC VOLTMETER", product of TREK, INC., not shown).

The measuring device 100 includes at least the charging roller 51, the second voltage probe 102, the static elimination lamp 54, and the first voltage probe 101. A measurement target photosensitive member 50 is set in the measuring device 100. The charging roller 51, the second voltage probe 102, the static elimination lamp 54, and the first voltage probe 101 are located around the photosensitive member 50 in the stated order from upstream in the rotation direction r of the photosensitive member 50.

The second voltage probe 102 is disposed such that an angle $\theta_1$ between a first line $L_1$ and a second line $L_2$ is 120 degrees, where the first line $L_1$ is a line connecting the rotation center 50X (the rotational axis) of the photosensitive member 50 and the rotation center 51X (the rotational axis) of the charging roller 51, and the second line $L_2$ is a line connecting the rotation center 50X (the rotational axis) of the photosensitive member 50 and the second voltage probe 102. An intersection point between the first line $L_1$ and the circumferential surface 50*a* of the photosensitive member 50 is a charging point $P_1$. An intersection point between the second line $L_2$ and the circumferential surface 50*a* of the photosensitive member 50 is a development point $P_2$.

The first voltage probe 101 is disposed such that an angle $\theta_2$ between a third line $L_3$ and the first line $L_1$ is 20 degrees, where the third line $L_3$ is a line connecting the rotation center 50X (the rotational axis) of the photosensitive member 50 and the first voltage probe 101, and the first line $L_1$ is the line connecting the rotation center 50X (the rotational axis) of the photosensitive member 50 and the rotation center 51X (the rotational axis) of the charging roller 51. An intersection point between the third line $L_3$ and the circumferential surface 50*a* of the photosensitive member 50 is a pre-charging point $P_3$.

A point where the circumferential surface 50*a* of the photosensitive member 50 is irradiated with static elimination light from the static elimination lamp 54 is a static elimination point $P_4$. The static elimination lamp 54 is disposed such that an angle $\theta_3$ between a fourth line $L_4$ and the third line $L_3$ is 90 degrees, where the fourth line $L_4$ is a line connecting the rotation center 50X (the rotational axis) of the photosensitive member 50 and the static elimination point $P_4$, and the third line $L_3$ is the line connecting the rotation center 50X (the rotational axis) of the photosensitive member 50 and the first voltage probe 101. A modified version of a multifunction peripheral ("TASKALFA 356Ci", product of KYOCERA Document Solutions Inc.) can be used as the measuring device 100.

In the measurement of the first potential $V_r$ and the second potential $V_0$, charging voltage that is applied to the charging roller 51 is set to each of +1,000 V, +1,100 V, +1,200 V, +1,300 V, +1,400 V, and +1,500 V. An intensity of the static elimination light upon arrival at the circumferential surface 50*a* of the photosensitive member 50 after having been emitted from the static elimination lamp 54 (referred to below as a static elimination light intensity) is set to 5 $\mu J/cm^2$. The first potential $V_r$ and the second potential $V_0$ are measured while the photosensitive member 50 is rotating about the rotation center 50X (the rotational axis). The charging roller 51 charges the circumferential surface 50*a* of the photosensitive member 50 to a positive polarity at the charging point $P_1$ of the photosensitive member 50. Next, the static elimination lamp 54 eliminates static electricity from the circumferential surface 50*a* of the photosensitive member 50 at the static elimination point $P_4$ of the photosensitive member 50. When the photosensitive member 50 has completed 10 rotations with the above-described charging and static elimination (also referred to below as a timing K), the first potential $V_r$ and the second potential $V_0$ are measured at the same time. Specifically, at the timing K, the potential (the first potential $V_r$) of the circumferential surface 50*a* of the photosensitive member 50 is measured using the first voltage probe 101 at the pre-charging point $P_3$ of the photosensitive member 50. Also, at the timing K, the potential (the second potential $V_0$) of the charged circumferential surface 50*a* of the photosensitive member 50 is measured using the second voltage probe 102 at the development point $P_2$ of the photosensitive member 50. As described above, the first potential $V_r$ and the second potential $V_0$ are measured under each of conditions of charging voltages applied to the charging roller 51 of +1,000 V, +1,100 V, +1,200 V, +1,300 V, +1,400 V, and +1,500 V.

Light irradiation by the light exposure device 31, development by the development roller 52, primary transfer by the primary transfer roller 53, and cleaning by the cleaning blade 81 are not performed in the measurement of the first potential $V_r$ and the second potential $V_0$. The linear pressure N of the cleaning blade 81 is set to 0 N/m. Through the above, the method for measuring the first potential $V_r$ and the second potential $V_0$ in expression (2) has been described. The following describes a method for measuring the chargeability ratio.

The charge amount Q in mathematical formula (1B) is measured under environmental conditions of a temperature of 23° C. and a relative humidity of 50%. The charge amount Q is measured according to the following method when the first potential $V_r$ and the second potential $V_0$ are measured. At the timing K of the simultaneous measurement of the first potential $V_r$ and the second potential $V_0$, current $E_1$ flowing through the charging roller 51 is measured using an ammeter/voltmeter ("MINIATURE PORTABLE AMMETER AND VOLTMETER 2051", product of Yokogawa Test & Measurement Corporation). The current $E_1$ is measured under each of conditions of charging voltages applied to the charging roller 51 of +1,000 V, +1,100 V, +1,200 V, +1,300 V, +1,400 V, and +1,500 V. The charge amount Q under each of conditions of charging voltages applied to the charging roller 51 of +1,000 V, +1,100 V, +1,200 V, +1,300 V, +1,400 V, and +1,500 V is calculated from the measured current $E_1$ in accordance with expression (3) shown below.

$$\text{Charge amount } Q = \text{current } E_1 \text{ (unit: A)} \times \text{charging time } t \text{ (unit: second)} \quad (3)$$

The charging roller 51 is connected with a high-voltage board (not shown) of the measuring device 100 via the ammeter/voltmeter. The current $E_1$ flowing through the charging roller 51 and the charging voltage mentioned in association with the measurement of the first potential $V_r$ and the second potential $V_0$ can be constantly monitored using the ammeter/voltmeter while the measuring device 100 is in operation.

The charge area S in mathematical formula (1B) is an area of a charged region of the circumferential surface 50*a* of the photosensitive member 50 charged by the charging roller 51. The charge area S is calculated in accordance with expression (4) shown below. A charge width in expression (4) is a length of the charged region of the circumferential surface 50*a* of the photosensitive member 50 charged by the charging roller 51 in terms of a longitudinal direction (a rotational axis direction D in FIG. 9) of the photosensitive member 50.

$$\text{Charge area } S \text{ (unit: m}^2\text{)} = \text{linear velocity of photosensitive member 50 (unit: m/second)} \times \text{charge width (m)} \times \text{charging time } t \text{ (unit: second)} \quad (4)$$

A value of "V" in mathematical formula (1B) is calculated from the first potential $V_r$ and the second potential $V_0$ measured as described above. A value of "Q/S" in mathematical formula (1B) is calculated from the charge amount Q and the charge area S measured as describe above. A graph is produced with "Q/S" value on a horizontal axis and "V" value on a vertical axis. Six points are plotted in the graph, indicating measurement results obtained under conditions of charging voltages applied to the charging roller 51 of +1,000 V, +1,100 V, +1,200 V, +1,300 V, +1,400 V, and +1,500 V. An approximate straight line on these six points is drawn. A gradient of the approximate straight line is determined from the approximate straight line. The determined gradient is taken to be "V/(Q/S)" in mathematical formula (1B).

A film thickness d of the photosensitive layer 502 in mathematical formula (1B) is measured under environmental conditions of a temperature of 23° C. and a relative humidity of 50%. The film thickness d of the photosensitive layer 502 is measured using a film thickness measuring device ("FISCHERSCOPE (registered Japanese trademark) MMS (registered Japanese trademark)", product of Helmut Fischer). Note that the film thickness of the photosensitive layer 502 according to the first embodiment is set to $30\times10^{-6}$ m.

$\varepsilon_0$ in mathematical formula (1B) represents a vacuum permittivity. The vacuum permittivity $\varepsilon_0$ is constant and is $8.85\times10^{-12}$ (unit: F/m).

The specific permittivity $\varepsilon_r$ of the binder resin in mathematical formula (1B) is equivalent to a specific permittivity of the photosensitive layer 502 on the assumption that no charge is trapped in the photosensitive layer 502 and the whole amount of charge from the charging roller 51 is changed to the potential (surface potential) of the circumferential surface 50*a* of the photosensitive member 50. The specific permittivity $\varepsilon_r$ of the binder resin is measured using a photosensitive member for specific permittivity measurement. The photosensitive member for specific permittivity measurement includes a photosensitive layer only containing the binder resin. The photosensitive member for specific permittivity measurement can be produced according to the same method as in production of photosensitive members according to Examples described below in all aspects other than that none of a charge generating material, a hole transport material, an electron transport material, and an additive is added. The specific permittivity $\varepsilon_r$ of the binder resin is calculated using the photosensitive member for specific permittivity measurement as a measurement target in accordance with expression (5) shown below. According to the first embodiment, the specific permittivity $\varepsilon_r$ of the binder resin calculated in accordance with expression (5) is 3.5.

$$V_\varepsilon = \frac{(Q_\varepsilon / S_\varepsilon) \times d_\varepsilon}{\varepsilon_r \times \varepsilon_0} \tag{5}$$

In expression (5), $Q_\varepsilon$ represents a charge amount (unit: C) of the photosensitive member for specific permittivity measurement. $S_\varepsilon$ represents a charge area (unit: $m^2$) of the photosensitive member for specific permittivity measurement. $d_\varepsilon$ represents a film thickness (unit: m) of the photosensitive layer for specific permittivity measurement. $\varepsilon_r$ represents a specific permittivity of the binder resin. $\varepsilon_0$ represents a vacuum permittivity (unit: F/m). $V_\varepsilon$ is a value calculated in accordance with the following expression: "$V_{0\varepsilon}-V_{r\varepsilon}$". $V_{r\varepsilon}$ represents a third potential of a circumferential surface of the photosensitive member for specific permittivity measurement yet to be charged by the charging roller 51. $V_{0\varepsilon}$ represents a fourth potential of the circumferential surface of the photosensitive member for specific permittivity measurement charged by the charging roller 51.

The film thickness $d_\varepsilon$ in expression (5) is calculated according to the same method as in the calculation of the film thickness d of the photosensitive member 50 in mathematical formula (1B) in all aspects other than that the photosensitive member for specific permittivity measurement is used instead of the photosensitive member 50. According to the first embodiment, the film thickness $d_\varepsilon$ in expression (5) is set to $30\times10^{-6}$ m. The vacuum permittivity $\varepsilon_0$ in expression (5) is constant and is $8.85\times10^{-12}$ F/m. The theoretical value 0 V is substituted into the third potential $V_{r\varepsilon}$ in expression (5). The charge amount $Q_\varepsilon$ of the photosensitive member for specific permittivity measurement in expression (5) is measured according to the same method as in the measurement of the charge amount Q of the photosensitive member 50 in mathematical formula (1B) in all aspects other than that the photosensitive member for specific permittivity measurement is used instead of the photosensitive member 50 and the charging voltage is set to +1,000 V. The charge area $S_\varepsilon$ of the photosensitive member for specific permittivity measurement in expression (5) is calculated according to the same method as in the calculation of the charge area S of the photosensitive member 50 in mathematical formula (1B) in all aspects other than that the photosensitive member for specific permittivity measurement is used instead of the photosensitive member 50. The fourth potential $V_{0\varepsilon}$ in expression (5) is measured according to the same method as in the measurement of the second potential $V_0$ of the photosensitive member 50 in expression (2) in all aspects other than that the photosensitive member for specific permittivity measurement is used instead of the photosensitive member 50. Using the thus obtained values, the specific permittivity $\varepsilon_r$ of the binder resin is calculated in accordance with expression (5).

Through the above, a method for measuring the chargeability ratio has been described. The following further describes the chargeability ratio with reference to FIG. 7. As already described, the chargeability ratio is a ratio of actual chargeability (measured value) of the photosensitive member 50 to theoretical chargeability (theoretical value) of the photosensitive member 50 when the circumferential surface 50*a* of the photosensitive member 50 is charged by the charging roller 51. The chargeability as used in the present specification indicates how much charge potential (unit: V) of the photosensitive member 50 increases for surface charge density (unit: $C/m^2$) of charge supplied from the charging roller 51. The theoretical chargeability (theoretical value) of the photosensitive member 50 is a value on the assumption that the whole amount of charge supplied from the charging roller 51 to the photosensitive member 50 is changed to the charge potential of the photosensitive member 50. The charge potential of the photosensitive member 50 is equivalent to a difference between the potential (first potential $V_r$) of the circumferential surface 50*a* of the photosensitive member 50 before a portion of the circumferential surface 50*a* of the photosensitive member 50 passes the charging roller 51 and the potential (second potential $V_0$) of the circumferential surface 50*a* of the photosensitive member 50 after the portion of the circumferential surface 50*a* of the photosensitive member 50 has passed the charging roller 51.

Figure 7:
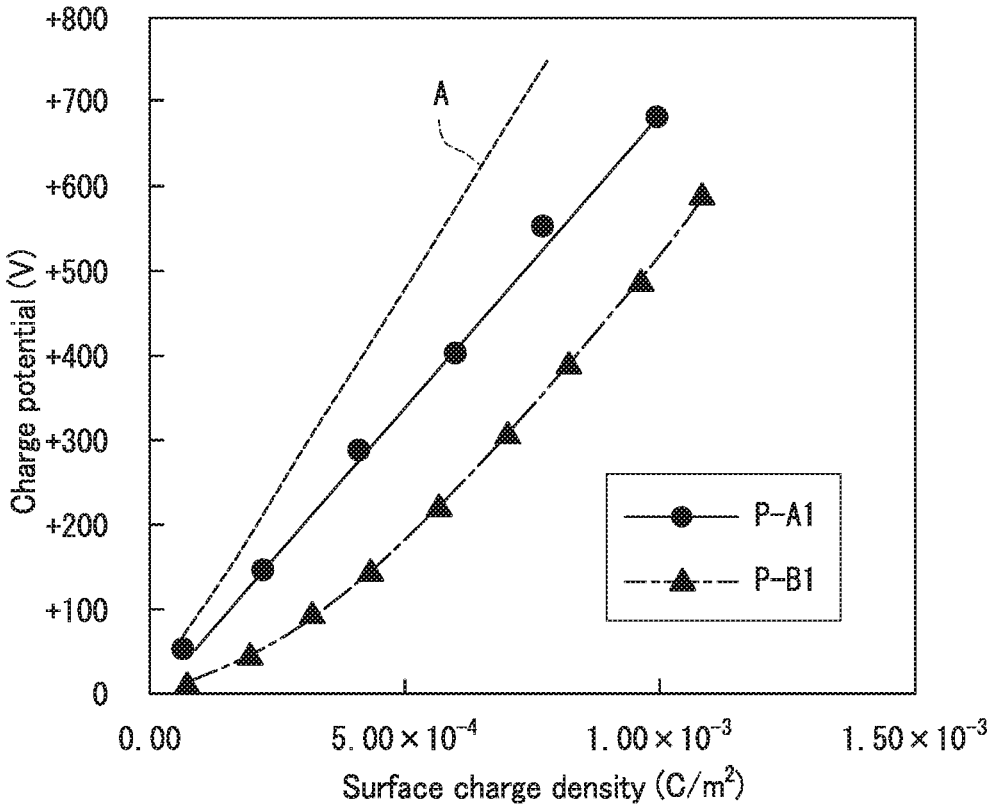
FIG. 7 is a graph representation illustrating a relationship between surface charge density and charge potential of photosensitive members.

FIG. 7 is a graph representation illustrating a relationship between the surface charge density (unit: $C/m^2$) and the charge potential (unit: V) of photosensitive members. The horizontal axis in FIG. 7 represents surface charge density. The surface charge density is a value corresponding to "Q/S" in mathematical formula (1B). The vertical axis in FIG. 7 represents charge potential. The charge potential is a value corresponding to "V" in mathematical formula (1B). The chargeability corresponds to the gradient "V/(Q/S)" of each graph shown in FIG. 7.

Circles on the plot in FIG. 7 indicate a measurement result of a photosensitive member (P-A1) having a chargeability ratio of at least 0.60. Triangles on the plot in FIG. 7 indicate a measurement result of a photosensitive member (P-B1) having a chargeability ratio of lower than 0.60. Note that the photosensitive members (P-A1) and (P-B1) are produced according to the method described in association with Examples. A dashed line A in FIG. 7 indicates the theoretical chargeability (theoretical value) of the photosensitive member 50. The theoretical chargeability (theoretical value) of the photosensitive member 50 is calculated in accordance with formula (6) shown below. The dashed line A in FIG. 7 is obtained by plotting values of "$Q_t/S_t$" in formula (6) on the horizontal axis and plotting values of "$V_t$" in formula (6) on the vertical axis.

$$V_t = V_{0t} - V_{rt} = \frac{(Q_t / S_t) \times d_t}{\varepsilon_{rt} \times \varepsilon_o} \tag{6}$$

In formula (6), $Q_t$ represents a charge amount (unit: C) of the photosensitive member 50. $S_t$ represents a charge area (unit: $m^2$) of the photosensitive member 50. $d_t$ represents a film thickness (unit: m) of the photosensitive layer 502 of the photosensitive member 50. $\varepsilon_{rt}$ represents a specific permittivity of the binder resin contained in the photosensitive layer 502 of the photosensitive member 50. $\varepsilon_0$ represents a vacuum permittivity (unit: F/m). $V_t$ is a value calculated in accordance with expression "$V_{0t}-V_{rt}$". $V_{rt}$ represents a fifth potential of the circumferential surface 50*a* of the photosensitive member 50 yet to be charged by the charging roller 51. $V_{0t}$ represents a sixth potential of the circumferential surface 50*a* of the photosensitive member 50 charged by the charging roller 51.

The film thickness $d_t$ in formula (6) is calculated according to the same method as in the calculation of the film thickness d of the photosensitive member 50 in mathematical formula (1B). According to the first embodiment, the film thickness $d_t$ in formula (6) is set to $30\times10^{-6}$ m. The vacuum permittivity $\varepsilon_0$ in formula (6) is constant and is $8.85\times10^{-12}$ F/m. The theoretical value 0 V is substituted into the fifth potential $V_{rt}$ in formula (6). The charge amount $Q_t$ of the photosensitive member 50 in formula (6) is measured according to the same method as in the measurement of the charge amount Q of the photosensitive member 50 in mathematical formula (1B). The charge area $S_t$ of the photosensitive member 50 in formula (6) is calculated according to the same method as in the calculation of the charge area S of the photosensitive member 50 in mathematical formula (1B). The specific permittivity $\varepsilon_{rt}$ of the binder resin in formula (6) is measured according to the same method as in the measurement of the specific permittivity $\varepsilon_r$ of the binder resin in mathematical formula (1B). The specific permittivity $\varepsilon_{rt}$ of the binder resin in formula (6) is 3.5, which is the same as the specific permittivity $\varepsilon_r$ of the binder resin in mathematical formula (1B). Using the thus obtained values, the sixth potential $V_{0t}$ and $V_t$ are calculated in accordance with formula (6).

As shown in FIG. 7, the higher and closer to 1.00 the chargeability ratio is, the closer to the dashed line A the chargeability (corresponding to the gradient in FIG. 7) is. Occurrence of a ghost image can be sufficiently inhibited as long as the photosensitive member 50 has a chargeability ratio of at least 0.60. Through the above, the chargeability ratio of the photosensitive member 50 has been described. The following further describes the photosensitive member 50.

The circumferential surface 50*a* of the photosensitive member 50 preferably has a surface friction coefficient of at least 0.20 and no greater than 0.80, more preferably at least 0.20 and no greater than 0.60, and still more preferably at least 0.20 and no greater than 0.52. As a result of the surface friction coefficient of the circumferential surface 50*a* of the photosensitive member 50 being no greater than 0.80, adhesion of the toner T to the circumferential surface 50*a* of the photosensitive member 50 is low enough to further prevent insufficient cleaning. As a result of the surface friction coefficient of the circumferential surface 50*a* of the photosensitive member 50 being no greater than 0.80, friction force of the cleaning blade 81 against the circumferential surface 50*a* of the photosensitive member 50 is low enough to further reduce abrasion of the photosensitive layer 502 of the photosensitive member 50. No particular limitations are placed on the lower limit of the surface friction coefficient of the circumferential surface 50*a* of the photosensitive member 50. The surface friction coefficient of the circumferential surface 50*a* of the photosensitive member 50 may for example be at least 0.20. The surface friction coefficient of the circumferential surface 50*a* of the photosensitive member 50 can be measured according to a method described in association with Examples.

In order to obtain a high-quality output image, a post-irradiation potential of the circumferential surface 50*a* of the photosensitive member 50 is preferably at least +50 V and no greater than +300 V, and more preferably at least +80 V and no greater than +200 V. The post-irradiation potential is a potential of an irradiated region of the circumferential surface 50*a* of the photosensitive member 50 irradiated with light by the light exposure device 31. The post-irradiation potential is measured before the development and after the light irradiation. The post-irradiation potential of the photosensitive member 50 can be measured according to a method described in association with Examples.

The photosensitive layer 502 preferably has a Martens hardness of at least 150 N/mm$^2$, more preferably at least 180 N/mm$^2$, still more preferably at least 200 N/mm$^2$, and further preferably at least 220 N/mm$^2$. As a result of the Martens hardness of the photosensitive layer 502 being at least 150 N/mm$^2$, the abrasion amount of the photosensitive layer 502 is reduced, improving abrasion resistance of the photosensitive member 50. No particular limitations are placed on the upper limit of the Martens hardness of the photosensitive layer 502. For example, the Martens hardness of the photosensitive layer 502 may be no greater than 250 N/mm$^2$. The Martens hardness of the photosensitive layer 502 can be measured according to a method described in association with Examples.

The photosensitive layer 502 contains a charge generating material, a hole transport material, an electron transport material, and a binder resin. The photosensitive layer 502 may further contain an additive as necessary. The following describes the charge generating material, the hole transport material, the electron transport material, the binder resin, and the additive, and preferable combinations of the materials.

(Charge Generating Material)

No particular limitations are placed on the charge generating material. Examples of charge generating materials that can be used include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The photosensitive layer 502 may contain only one charge generating material or may contain two or more charge generating materials.

Examples of phthalocyanine-based pigments that are preferable in terms of inhibiting occurrence of a ghost image include metal-free phthalocyanine, titanyl phthalocyanine, and chloroindium phthalocyanine, among which titanyl phthalocyanine is more preferable. The titanyl phthalocyanine is represented by chemical formula (CGM-1).

(CGM-1)

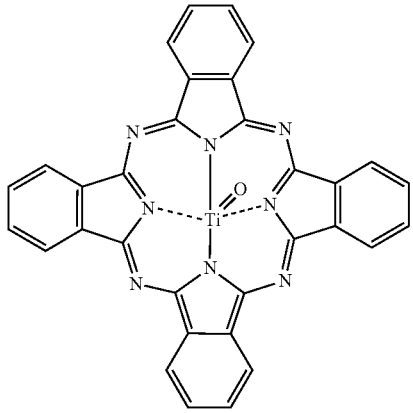

The titanyl phthalocyanine may have a crystal structure. Examples of titanyl phthalocyanine having a crystal structure include titanyl phthalocyanine having an α-form crystal structure, titanyl phthalocyanine having β-form crystal structure, and titanyl phthalocyanine having a Y-form crystal structure (also referred to below as α-form titanyl phthalocyanine, β-form titanyl phthalocyanine, and Y-form titanyl phthalocyanine, respectively). Preferably, the titanyl phthalocyanine is Y-form titanyl phthalocyanine.

Y-form titanyl phthalocyanine for example exhibits a main peak at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ+0.2°) from 3° to 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning rate is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of from 50° C. to 270° C. in a differential scanning calorimetry spectrum thereof, other than a peak resulting from vaporization of adsorbed water.

(B) Y-form titanyl phthalocyanine that does not exhibit a peak in a range of from 50° C. to 400° C. in a differential scanning calorimetry spectrum thereof, other than a peak resulting from vaporization of adsorbed water.

(C) Y-form titanyl phthalocyanine that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water.

Y-form titanyl phthalocyanine is preferable that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water. The Y-form titanyl phthalocyanine that exhibits such a peak is preferably Y-form titanyl phthalocyanine that exhibits a single peak in a range of higher than 270° C. and no higher than 400° C., and more preferably Y-form titanyl phthalocyanine that exhibits a single peak at 296° C.

The following describes an example of a method for measuring a differential scanning calorimetry spectrum. A sample (titanyl phthalocyanine) is loaded into a sample pan, and a differential scanning calorimetry spectrum is measured using a differential scanning calorimeter (for example, "TAS-200 DSC8230D", product of Rigaku Corporation). The measurement range is for example from 40° C. to 400° C. The heating rate is for example 20° C./minute.

The charge generating material is preferably contained in an amount of greater than 0.0% by mass and no greater than 1.0% by mass relative to mass of the photosensitive layer 502, and more preferably in an amount of greater than 0.0% by mass and no greater than 0.5% by mass. As a result of the amount of the charge generating material being no greater than 1.0% by mass relative to the mass of the photosensitive layer 502, an increased chargeability ratio can be achieved. The mass of the photosensitive layer 502 is a total mass of materials contained in the photosensitive layer 502. In the case of the photosensitive layer 502 containing a charge generating material, a hole transport material, an electron transport material, and a binder resin, the mass of the photosensitive layer 502 is a sum of mass of the charge generating material, mass of the hole transport material, mass of the electron transport material, and mass of the binder resin. In the case of the photosensitive layer 502 containing a charge generating material, a hole transport material, an electron transport material, a binder resin, and an additive, the mass of the photosensitive layer 502 is a sum of mass of the charge generating material, mass of the hole transport material, mass of the electron transport material, mass of the binder resin, and mass of the additive.

(Hole Transport Material)

No particular limitations are placed on the hole transport material. Examples of hole transport materials that can be used include nitrogen-containing cyclic compounds and condensed polycyclic compounds. Examples of nitrogen-containing cyclic compounds and condensed polycyclic compounds that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer 502 may contain only one hole transport material or may contain two or more hole transport materials.

Examples of hole transport materials that are preferable in terms of inhibiting occurrence of a ghost image include a compound represented by general formula (10) (also referred to below as a hole transport material (10)).

(10)

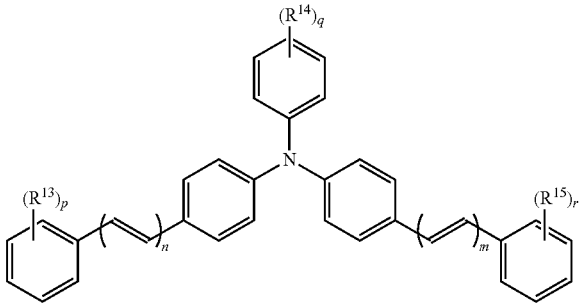

In general formula (10), $R^{13}$ to $R^{15}$ each represent, independently of one another, an alkyl group having a carbon number of at least 1 and no greater than 4 or an alkoxy group having a carbon number of at least 1 and no greater than 4. m and n each represent, independently of one another, an integer of at least 1 and no greater than 3. p and r each represent, independently of one another, 0 or 1. q represents an integer of at least 0 and no greater than 2. When q represents 2, two chemical groups $R^{14}$ may be the same as or different from one another.

In general formula (10), $R^{14}$ preferably represents an alkyl group having a carbon number of at least 1 and no greater than 4, more preferably a methyl group, an ethyl group, or an n-butyl group, and particularly preferably an n-butyl group. Preferably, q represents 1 or 2. More preferably, q represents 1. Preferably, p and r each represent 0. Preferably, m and n each represent 1 or 2. More preferably, m and n each represent 2.

Examples of preferable hole transport materials (10) include a compound represented by chemical formula (HTM-1) (also referred to below as a hole transport material (HTM-1)).

(HTM-1)

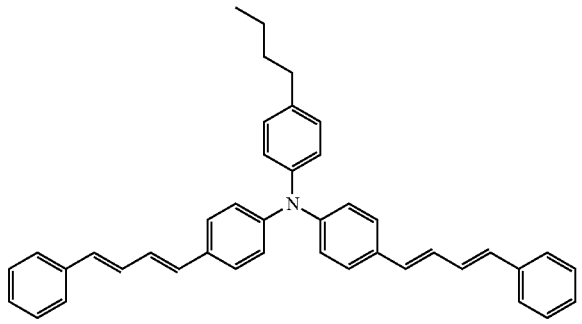

The hole transport material is preferably contained in an amount of greater than 0.0% by mass and no greater than 35.0% by mass relative to the mass of the photosensitive layer 502, and more preferably in an amount of at least 10.0% by mass and no greater than 30.0% by mass.

(Binder Resin)

Examples of binder resins that can be used include thermoplastic resins, thermosetting resins, and photocurable resins. Examples of thermoplastic resins that can be used include polycarbonate resins, polyarylate resins, styrene-butadiene copolymers, styrene-acrylonitrile copolymers, styrene-maleate copolymers, acrylic acid polymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include acrylic acid adducts of epoxy compounds and acrylic acid adducts of urethane compounds. The photosensitive layer 502 may contain only one binder resin or may contain two or more binder resins.

In order to inhibit occurrence of a ghost image, preferably, the binder resin includes a polyarylate resin including a repeating unit represented by general formula (20) (also referred to below as a polyarylate resin (20)).

(20)

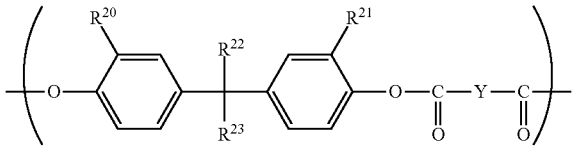

In general formula (20), $R^{20}$ and $R^{21}$ each represent, independently of one another, a hydrogen atom or an alkyl group having a carbon number of at least 1 and no greater than 4. $R^{22}$ and $R^{23}$ each represent, independently of one another, a hydrogen atom, a phenyl group, or an alkyl group having a carbon number of at least 1 and no greater than 4. $R^{22}$ and $R^{23}$ may be bonded to one another to form a divalent group represented by general formula (W). Y represents a divalent group represented by chemical formula (Y1), (Y2), (Y3), (Y4), (Y5), or (Y6).

(W)

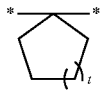

In general formula (W), t represents an integer of at least 1 and no greater than 3. Asterisks each represent a bond. Specifically, the asterisks in general formula (W) each represent a bond to a carbon atom bonded to Y in general formula (20).

(Y1)

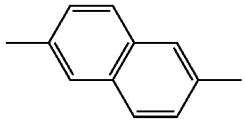

-continued (Y2)

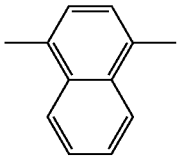

(Y3)

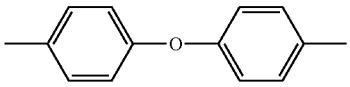

(Y4)

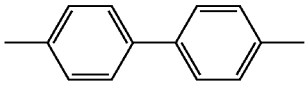

(Y5)

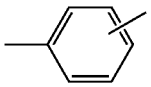

(Y6)

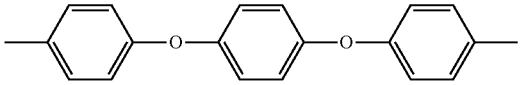

In general formula (20), $R^{20}$ and $R^{21}$ are each preferably an alkyl group having a carbon number of at least 1 and no greater than 4, and more preferably a methyl group. $R^{22}$ and $R^{23}$ are preferably bonded to one another to form a divalent group represented by general formula (W). Preferably, Y is a divalent group represented by chemical formula (Y1) or (Y3). In general formula (W), t is preferably 2.

Preferably, the polyarylate resin (20) only includes the repeating unit represented by general formula (20). However, the polyarylate resin (20) may further include another repeating unit. A ratio (mole fraction) of the number of the repeating units represented by general formula (20) to the total number of repeating units in the polyarylate resin (20) is preferably at least 0.80, more preferably at least 0.90, and still more preferably 1.00. The polyarylate resin (20) may only include one repeating unit represented by general formula (20) or may include a plurality of (for example, two) repeating units each represented by general formula (20).

Note that the ratio (mole fraction) of the number of the repeating units represented by general formula (20) to the total number of repeating units in the polyarylate resin (20) is not a value obtained from one resin chain but a number average obtained from all molecules of the polyarylate resin (20) (a plurality of resin chains) contained in the photosensitive layer 502. The mole fraction can for example be calculated from a $^{1}$H-NMR spectrum of the polyarylate resin (20) measured using a proton nuclear magnetic resonance spectrometer.

Examples of preferable repeating units represented by general formula (20) include repeating units represented by chemical formula (20-a) and chemical formula (20-b) (also referred to below as repeating units (20-a) and (20-b), respectively). The polyarylate resin (20) preferably includes at least one of the repeating units (20-a) and (20-b), and more preferably includes both of the repeating units (20-a) and (20-b).

(20-a)

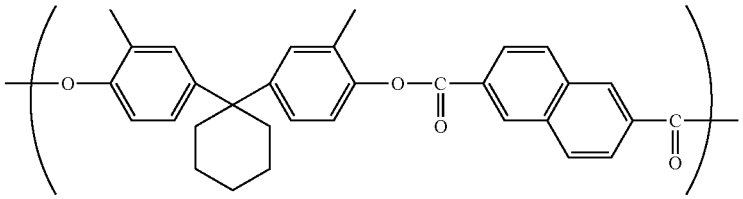

(20-b)

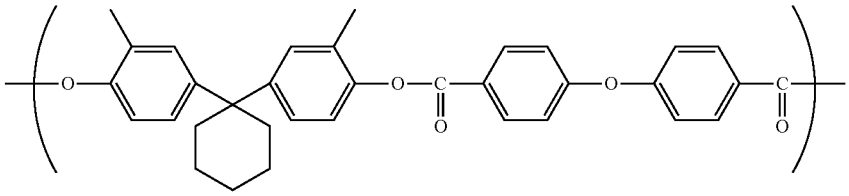

In the case of the polyarylate resin (20) including both of the repeating units (20-a) and (20-b), no particular limitations are placed on the sequence of the repeating units (20-a) and (20-b). The polyarylate resin (20) including the repeating units (20-a) and (20-b) may be any of a random copolymer, a block copolymer, a periodic copolymer, or an alternating copolymer.

Examples of preferable polyarylate resins (20) including both of the repeating units (20-a) and (20-b) include a polyarylate resin having a main chain represented by general formula (20-1).

(20-1)

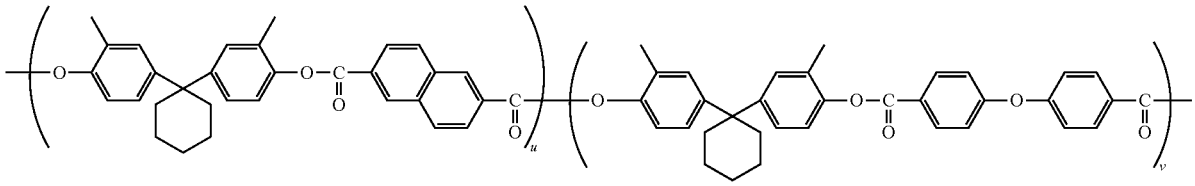

In general formula (20-1), a sum of u and v is 100. u is a number greater than or equal to 30 and less than or equal to 70.

Preferably, u is a number greater than or equal to 40 and less than or equal to 60, more preferably a number greater than or equal to 45 and less than or equal to 55, still more preferably a number greater than or equal to 49 and less than or equal to 51, and particularly preferably 50. Note that u represents a percentage of the number of the repeating units (20-a) relative to a sum of the number of the repeating units (20-a) and the number of the repeating units (20-b) in the polyarylate resin (20). v represents a percentage of the number of the repeating units (20-b) relative to the sum of the number of the repeating units (20-a) and the number of the repeating units (20-b) in the polyarylate resin (20). Examples of preferable polyarylate resins having a main chain represented by general formula (20-1) include a polyarylate resin having a main chain represented by general formula (20-1a).

(20-1a)

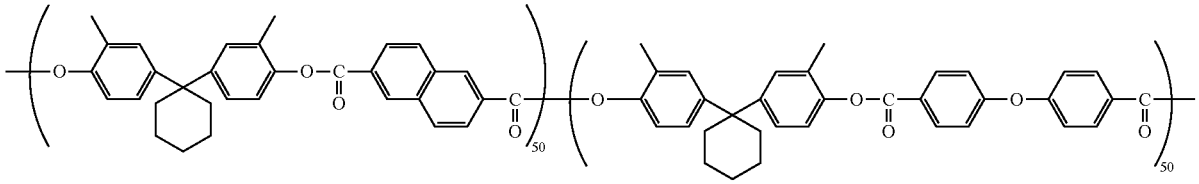

The polyarylate resin (20) may have a terminal group represented by chemical formula (Z). An asterisk in chemical formula (Z) represents a bond. Specifically, the asterisk in chemical formula (Z) represents a bond to the main chain of the polyarylate resin. In the case of the polyarylate resin (20) including the repeating unit (20-a), the repeating unit (20-b), and the terminal group represented by chemical formula (Z), the terminal group may be bonded to the repeating unit (20-a) or may be bonded to the repeating unit (20-b).

(Z)

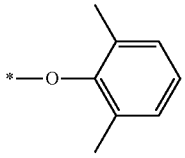

In order to inhibit occurrence of a ghost image, preferably, the polyarylate resin (20) includes a polyarylate resin having a main chain represented by general formula (20-1) and a terminal group represented by chemical formula (Z). More preferably, the polyarylate resin (20) includes a polyarylate resin having a main chain represented by general formula (20-1a) and a terminal group represented by chemical formula (Z). The polyarylate resin having a main chain represented by general formula (20-1a) and a terminal group represented by chemical formula (Z) is also referred to below as a polyarylate resin (R-1).

The binder resin preferably has a viscosity average molecular weight of at least 10,000, more preferably at least 20,000, still more preferably at least 30,000, further preferably at least 50,000, and particularly preferably at least 55,000. As a result of the viscosity average molecular weight of the binder resin being at least 10,000, the photosensitive member 50 tends to have improved abrasion resistance. The viscosity average molecular weight of the binder resin is preferably no greater than 80,000, and more preferably no greater than 70,000. As a result of the viscosity average molecular weight of the binder resin being no greater than 80,000, the binder resin tends to readily dissolve in a solvent for photosensitive layer formation, facilitating formation of the photosensitive layer 502.

The binder resin is preferably contained in an amount of at least 30.0% by mass and no greater than 70.0% by mass relative to the mass of the photosensitive layer 502, and more preferably in an amount of at least 40.0% by mass and no greater than 60.0% by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer 502 may contain only one electron transport material or may contain two or more electron transport materials.

Examples of electron transport materials that are preferable in terms of inhibiting occurrence of a ghost image include compounds represented by general formula (31), general formula (32), and general formula (33) (also referred to below as electron transport materials (31), (32), and (33), respectively).

(31)

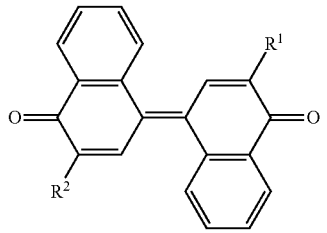

(32)

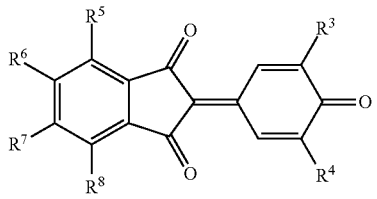

(33)

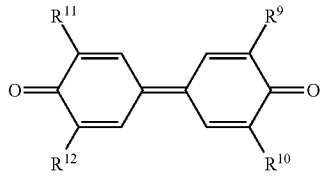

In general formulae (31) to (33), $R^1$ to $R^4$ and $R^9$ to $R^{12}$ each represent, independently of one another, an alkyl group having a carbon number of at least 1 and no greater than 8. $R^5$ to $R^8$ each represent, independently of one another, a hydrogen atom, a halogen atom, or an alkyl group having a carbon number of at least 1 and no greater than 4.

In general formulae (31) to (33), the alkyl group having a carbon number of at least 1 and no greater than 8 that may be represented by $R^1$ to $R^4$ and $R^9$ to $R^{12}$ is preferably an alkyl group having a carbon number of at least 1 and no greater than 5, and more preferably a methyl group, a tert-butyl group, or a 1,1-dimethylpropyl group. Preferably, $R^5$ to $R^8$ are each a hydrogen atom.

Preferably, the electron transport material (31) is a compound represented by chemical formula (ETM-1) (also referred to below as an electron transport material (ETM-1)). Preferably, the electron transport material (32) is a compound represented by chemical formula (ETM-3) (also referred to below as an electron transport material (ETM-3)). Preferably, the electron transport material (33) is a compound represented by chemical formula (ETM-2) (also referred to below as an electron transport material (ETM-2)).

(ETM-1)

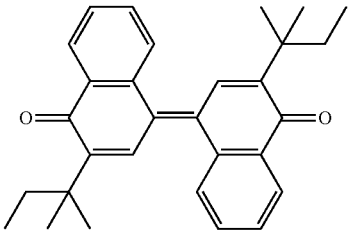

(ETM-2)

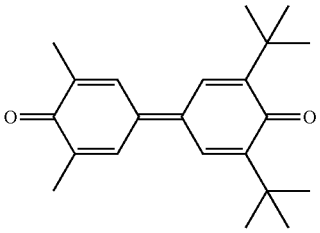

(ETM-3)

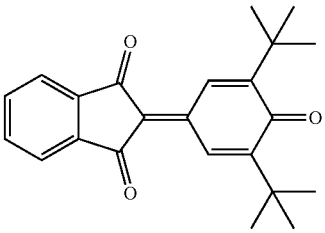

In order to inhibit occurrence of a ghost image, the photosensitive layer 502 preferably contains at least one of the electron transport materials (31) and (32), and more preferably contains both (two) of the electron transport materials (31) and (32) as the electron transport material.

In order to inhibit occurrence of a ghost image, the photosensitive layer 502 preferably contains at least one of the electron transport materials (ETM-1) and (ETM-3), and more preferably contains both (two) of the electron transport materials (ETM-1) and (ETM-3).

The electron transport material is preferably contained in an amount of at least 5.0% by mass and no greater than 50.0% by mass relative to the mass of the photosensitive layer 502, and more preferably in an amount of at least 20.0% by mass and no greater than 30.0% by mass. In the case of the photosensitive layer 502 containing two or more electron transport materials, the amount of the electron transport material refers to a total amount of the two or more electron transport materials.

(Additive)

The photosensitive layer 502 may further contain a compound represented by general formula (40) (also referred to below as an additive (40)) as necessary. However, in order to increase the chargeability ratio, it is preferable that the photosensitive layer 502 does not contain the additive (40). In a situation in which the use of the additive (40) is necessary, the additive (40) is for example contained in an amount of greater than 0.0% by mass and no greater than 1.0% by mass relative to the mass of the photosensitive layer 502. The additive (40) can for example be used to adjust the chargeability ratio.

$$R^{40}\text{-A-}R^{41} \quad (40)$$

In general formula (40), $R^{40}$ and $R^{41}$ each represent, independently of one another, a hydrogen atom or a monovalent group represented by general formula (40a) shown below.

(40a)

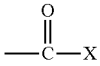

In general formula (40a), X represents a halogen atom. Examples of halogen atoms that may be represented by X include a fluorine atom, a chlorine atom, a bromine atom, and an iodine atom. Preferably, the halogen atom represented by X is a chlorine atom.

In general formula (40), A represents a divalent group represented by chemical formula (A1), (A2), (A3), (A4), (A5), or (A6) shown below. Preferably, the divalent group represented by A is the divalent group represented by chemical formula (A4).

(A1)

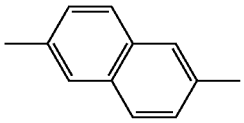

(A2)

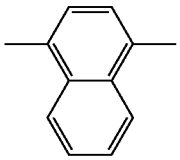

(A3)

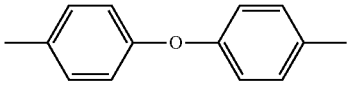

(A4)

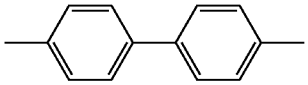

(A5)

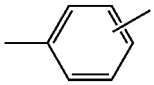

(A6)

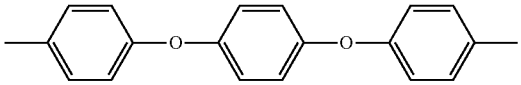

Specific examples of additives (40) include a compound represented by chemical formula (40-1) (also referred to below as an additive (40-1)).

(40-1)

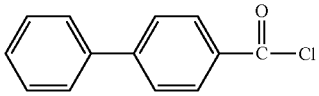

The photosensitive layer 502 may further contain an additive other than the additive (40) (also referred to below as an additional additive) as necessary. Examples of additional additives that can be used include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. In the case of the photosensitive layer 502 containing an additional additive, the photosensitive layer 502 may contain one additional additive or may contain two or more additional additives.

(Combination of Materials)

In order to inhibit occurrence of a ghost image, the photosensitive layer 502 preferably contains any one of combinations of materials of types and in amounts shown as combination examples No. 1 to 3 in Table 1, and more preferably any one of combinations of materials of types and in amounts shown as combination examples No. 4 to 6 in Table 2, or any one of combinations of materials of types and in amounts shown as combination examples No. 7 to 9 in Table 3.

TABLE 1

| Combination | CGM | ETM | Additive | |
|---|---|---|---|---|
| example | Amount | Type | Type | Amount |
| No. 1 | Greater than 0.5 wt % and no greater than 1.0 wt % | ETM-1/ETM-3 | 40-1 | Greater than 0.0 wt % and no greater than 1.0 wt % |
| No. 2 | Greater than 0.5 wt % and no greater than 1.0 wt % | ETM-1/ETM-3 | — | — |
| No. 3 | Greater than 0.0 wt % and no greater than 0.5 wt % | ETM-1/ETM-3 | — | — |

TABLE 2

| Combination | CGM | HTM | ETM | Additive | |
|---|---|---|---|---|---|
| example | Amount | Type | Type | Type | Amount |
| No. 4 | Greater than 0.5 wt % and no greater than 1.0 wt % | HTM-1 | ETM-1/ETM-3 | 40-1 | Greater than 0.0 wt % and no greater than 1.0 wt % |
| No. 5 | Greater than 0.5 wt % and no greater than 1.0 wt % | HTM-1 | ETM-1/ETM-3 | — | — |
| No. 6 | Greater than 0.0 wt % and no greater than 0.5 wt % | HTM-1 | ETM-1/ETM-3 | — | — |

TABLE 3

| Combination | CGM | | HTM | ETM | Resin | Additive | |
|---|---|---|---|---|---|---|---|
| example | Type | Amount | Type | Type | Type | Type | Amount |
| No. 7 | CGM-1 | Greater than 0.5 wt % and no greater than 1.0 wt % | HTM-1 | ETM-1/ETM-3 | R-1 | 40-1 | Greater than 0.0 wt % and no greater than 1.0 wt % |
| No. 8 | CGM-1 | Greater than | HTM-1 | ETM-1/ETM-3 | R-1 | — | — |

TABLE 3-continued

| Combination example | CGM Type | CGM Amount | HTM Type | ETM Type | Resin Type | Additive Type | Additive Amount |
|---|---|---|---|---|---|---|---|
| | | 0.5 wt % and no greater than 1.0 wt % | | | | | |
| No. 9 | CGM-1 | Greater than 0.0 wt % and no greater than 0.5 wt % | HTM-1 | ETM-1/ETM-3 | R-1 | — | — |

In Tables 1 to 3, "wt %", "CGM", "HTM", "ETM", and "Resin" respectively mean "% by mass", "charge generating material", "hole transport material", "electron transport material", and "binder resin". In Tables 1 to 3, "Amount" means an amount of the material relative to the mass of the photosensitive layer 502. In Tables 1 to 3, "ETM-1/ETM-3" means that both of the electron transport materials (ETM-1) and (ETM-3) are used. In Tables 1 to 3, "–" means that the material is not contained. In Table 3, "CGM-1" means Y-form titanyl phthalocyanine represented by chemical formula (CGM-1). Preferably, the Y-form titanyl phthalocyanine shown in Table 3 is Y-form titanyl phthalocyanine that does not exhibit a peak in a range of from 50° C. to 270° C. and that exhibits a peak in a range of higher than 270° C. and no higher than 400° C. (specifically, a single peak at 296° C.) in a differential scanning calorimetry spectrum thereof, other than a peak resulting from vaporization of adsorbed water.

(Intermediate Layer)

The intermediate layer 503 for example contains inorganic particles and a resin for use in the intermediate layer 503 (intermediate layer resin). Provision of the intermediate layer 503 can facilitate flow of current generated when the photosensitive member 50 is irradiated with light and inhibit increasing resistance, while also maintaining insulation to a sufficient degree so as to inhibit occurrence of leakage current.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. The inorganic particles may be surface-treated. No particular limitations are placed on the intermediate layer resin other than being a resin that can be used to form the intermediate layer 503.

(Production Method of Photosensitive Member)

According to an example of the production method of the photosensitive member 50, an application liquid for formation of the photosensitive layer 502 (also referred to below as an application liquid for photosensitive layer formation) is applied onto the conductive substrate 501 and dried. Through the above, the photosensitive layer 502 is formed, producing the photosensitive member 50. The application liquid for photosensitive layer formation is prepared by dissolving or dispersing a charge generating material, a hole transport material, an electron transport material, a binder resin, and an optional component as necessary in a solvent.

No particular limitations are placed on the solvent contained in the application liquid for photosensitive layer formation other than that the components of the application liquid should be soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member 50, a non-halogenated solvent (a solvent other than a halogenated hydrocarbon) is preferably used.

The application liquid for photosensitive layer formation is prepared by dispersing the components in the solvent by mixing. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied other than being a method that enables uniform application of the application liquid for photosensitive layer formation on the conductive substrate 501. Examples of application methods that can be used include blade coating, dip coating, spray coating, spin coating, and bar coating.

No particular limitations are placed on the method by which the application liquid for photosensitive layer formation is dried other than being a method that enables evaporation of the solvent in the application liquid for photosensitive layer formation. An example of a method involves heat treatment (hot-air drying) using a high-temperature dryer or a reduced pressure dryer. The heat treatment temperature is for example from 40° C. to 150° C. The heat treatment time is for example from 3 minutes to 120 minutes.

Note that the production method of the photosensitive member 50 may further include either or both of a process of forming the intermediate layer 503 and a process of forming the protective layer 504 as necessary. The process of forming the intermediate layer 503 and the process of forming the protective layer 504 are each performed according to a method appropriately selected from known methods.

Through the above, the photosensitive member 50 has been described. Referring again to FIG. 2, the following describes the toners T, the charging rollers 51, the primary transfer rollers 53, the static elimination lamps 54, and the cleaners 55 in the image forming apparatus 1.

<Toner>

The following describes the toners T that are contained in the cartridges 60M to 60BK illustrated in FIG. 1 and supplied to the circumferential surfaces 50*a* of the photosensitive members 50. Each toner T includes toner particles.

The toner T is a collection (a powder) of the toner particles. The toner particles each have a toner mother particle and an external additive. The toner mother particle includes at least one of a binder resin, a releasing agent, a colorant, a charge control agent, and a magnetic powder. The external additive adheres to a surface of the toner mother particle. The toner particles do not need to contain any external additive if unnecessary. In a situation in which the toner particles do not contain any external additive, the toner mother particles are equivalent to the toner particles. The toner T may be a capsule toner or a non-capsule toner. The capsule toner T can be prepared by forming a shell layer on the surface of each toner mother particle.

Preferably, the toner T has a number average roundness of at least 0.960 and no greater than 0.998. As a result of the number average roundness of the toner T being at least 0.960, development and transfer can be performed favorably, so that a truer image can be output. As a result of the number average roundness of the toner T being no greater than 0.998, the toner T is prevented from easily passing through the gap between the cleaning blade 81 and the circumferential surface 50*a* of the photosensitive member 50. The number average roundness of the toner T is preferably at least 0.960 and no greater than 0.980, more preferably at least 0.965 and no greater than 0.980, still more preferably at least 0.970 and no greater than 0.980, and particularly preferably at least 0.975 and no greater than 0.980. The number average roundness of the toner T can be measured according to a method described in association with Examples.

The toner T preferably has a volume median diameter (also referred to below as $D_{50}$) of at least 4.0 μm and no greater than 7.0 μm. As a result of $D_{50}$ of the toner T being no greater than 7.0 μm, non-grainy high-definition output image can be obtained. The amount of the toner T necessary to obtain a desired image density decreases with a decrease in $D_{50}$ of the toner T. It is therefore possible to reduce the amount of the toner T to be used as long as $D_{50}$ of the toner T is no greater than 7.0 μm. As a result of $D_{50}$ of the toner T being at least 4.0 μm the toner T does not easily pass through the gap between the cleaning blade 81 and the circumferential surface 50*a* of the photosensitive member 50. $D_{50}$ of the toner T is preferably at least 4.0 μm and no greater than 6.0 μm, and more preferably at least 4.0 μm and no greater than 5.0 μm. $D_{50}$ of the toner T can be measured according to a method described in association with Examples. Note that $D_{50}$ of the toner T is a value of particle diameter at 50% of cumulative distribution of a volume distribution of the toner T measured using a particle size distribution analyzer.

The image forming apparatus 1 according to the first embodiment can inhibit occurrence of a ghost image even if the toner T has such a small particle diameter and such a high roundness as described above, and the cleaning blade 81 is tightly pressed against the photosensitive member 50.

<Charging Roller>

Each charging roller 51 is located in contact with or adjacent to the circumferential surface 50*a* of the corresponding photosensitive member 50. The image forming apparatus 1 adopts a direct discharge process or a proximity discharge process. The charging time is shorter and the charge amount to the photosensitive member 50 is smaller in a configuration including the charging roller 51 located in contact with or adjacent to the circumferential surface 50*a* of the photosensitive member 50 than in a configuration including a scorotron charger. In image formation using the image forming apparatus 1 including the charging roller 51 located in contact with or adjacent to the circumferential surface 50*a* of the photosensitive member 50, therefore, it is difficult to uniformly charge the circumferential surface 50*a* of the photosensitive member 50 and a ghost image can easily occur. However, as already described, the image forming apparatus 1 according to the first embodiment can inhibit occurrence of a ghost image. According to the first embodiment, therefore, it is possible to sufficiently inhibit occurrence of a ghost image even if the charging roller 51 is located in contact with or adjacent to the circumferential surface 50*a* of the photosensitive member 50.

A distance between the charging roller 51 and the circumferential surface 50*a* of the photosensitive member 50 is preferably no greater than 50 μm, and more preferably no greater than 30 μm. The image forming apparatus 1 according to the first embodiment can sufficiently inhibit occurrence of a ghost image even if the distance between the charging roller 51 and the circumferential surface 50*a* of the photosensitive member 50 is in the above-specified range.

The charging voltage (charging bias) that is applied to the charging roller 51 is a direct current voltage. The amount of electrical discharge from the charging roller 51 to the photosensitive member 50 can be smaller and the abrasion amount of the photosensitive layer 502 of the photosensitive member 50 can be smaller in a configuration in which the charging voltage is a direct current voltage than in a configuration in which the charging voltage is a composite voltage of an alternating current voltage superimposed on a direct current voltage.

A ghost image tends to occur particularly when the charging roller 51 is located in contact with or adjacent to the circumferential surface 50*a* of the photosensitive member 50 and the charging voltage is a direct current voltage. However, as long as the photosensitive member 50 satisfies mathematical formula (1B), the image forming apparatus 1 according to the first embodiment can inhibit occurrence of a ghost image even if the charging roller 51 is located in contact with or adjacent to the circumferential surface 50*a* of the photosensitive member 50 and the charging voltage is a direct current voltage.

The charging roller 51 preferably has a resistance of at least 5.0 log Ω and no greater than 7.0 log Ω, and more preferably at least 5.0 log Ω and no greater than 6.0 log Ω. As a result of the resistance of the charging roller 51 being at least 5.0 log Ω, leakage current in the photosensitive layer 502 of the photosensitive member 50 tends not to occur. As a result of the resistance of the charging roller 51 being no greater than 7.0 log Ω, elevation of the resistance of the charging roller 51 tends not to occur. The resistance of the charging roller 51 can be measured according to a method described in association with Examples.

<Primary Transfer Roller>

Figure 8:
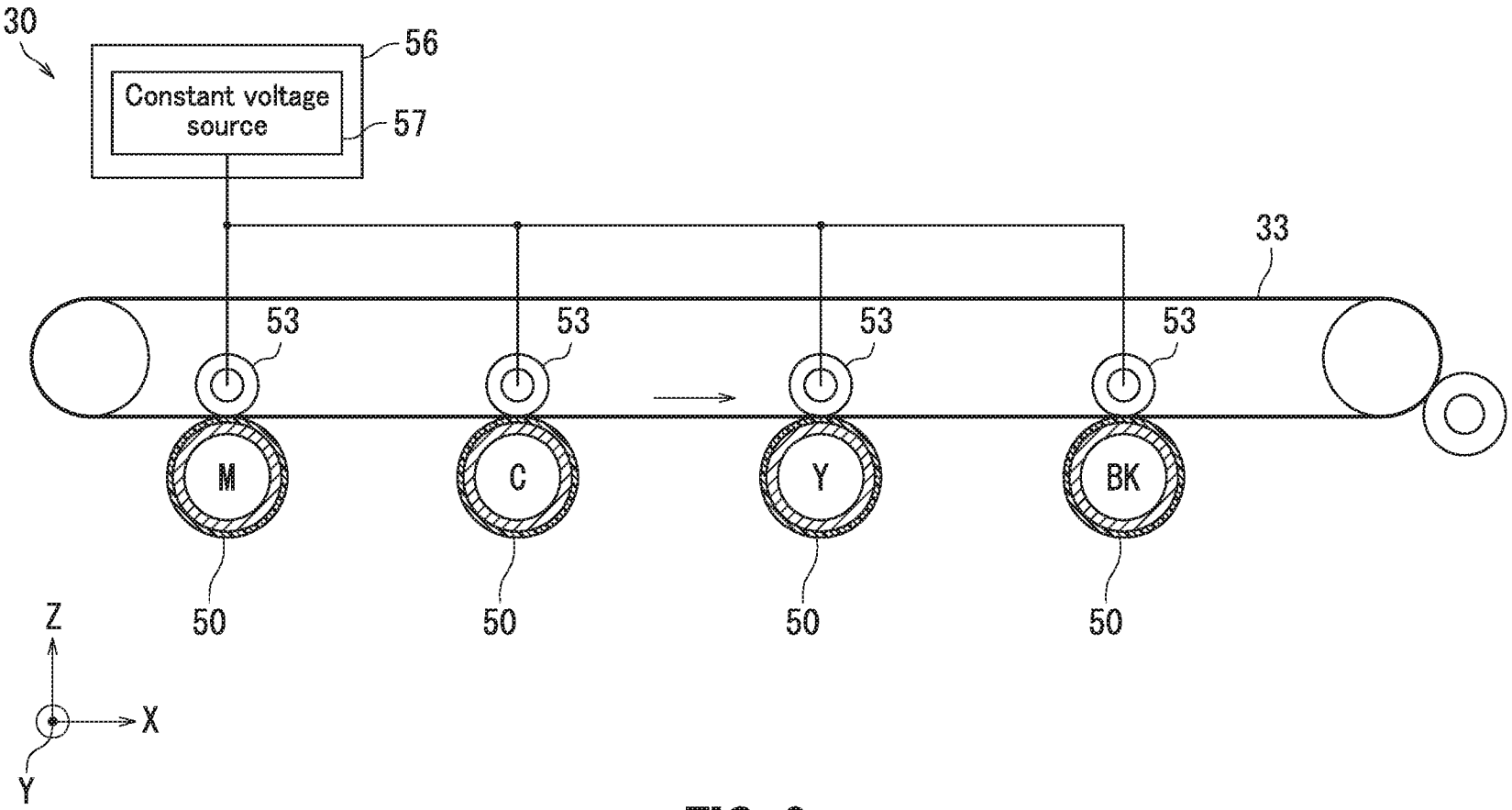
FIG. 8 is a diagram illustrating a power supply system for primary transfer rollers included in the image forming apparatus illustrated in FIG. 1.

The following describes the primary transfer rollers 53, which are under constant-voltage control, with reference to FIG. 8. FIG. 8 is a diagram illustrating a power supply system for the four primary transfer rollers 53. As illustrated in FIG. 8, the image forming section 30 further includes a power source 56 connected with the four primary transfer rollers 53. The power source 56 can charge each of the primary transfer rollers 53. The power source 56 includes a constant voltage source 57 connected with the four primary transfer rollers 53. The constant voltage source 57 applies a transfer voltage (a transfer bias) to the primary transfer rollers 53 to charge the primary transfer rollers 53 in primary transfer. The constant voltage source 57 generates a constant transfer bias (for example, a constant negative transfer bias). That is, the primary transfer rollers 53 are under constant-voltage control. A potential difference (transfer fields) between the surface potential of the circumferential surfaces 50*a* of the photosensitive members 50 and the surface potential of the primary transfer rollers 53 causes primary transfer of the toner images carried on the circumferential surfaces 50*a* of the respective photosensitive members 50 to the outer surface of the circulating transfer belt 33.

In primary transfer, a current (for example, a negative current) flows from the primary transfer rollers 53 into the respective photosensitive members 50 through the transfer belt 33. In a configuration in which the primary transfer rollers 53 are disposed right above the respective photosensitive members 50, the current flows from the primary transfer rollers 53 into the photosensitive members 50 in a thickness direction of the transfer belt 33. The current flowing into the photosensitive members 50 (flow-in current) changes as the volume resistivity of the transfer belt 33 changes provided that a constant transfer voltage is applied to the primary transfer rollers 53. The tendency of a ghost image to occur increases with an increase in the flow-in current. That is, a ghost image is more likely to occur in an image formed by the image forming apparatus 1 including the primary transfer rollers 53, which are under constant-voltage control, than in an image formed by an image forming apparatus that adopts constant-current control. However, the image forming apparatus 1 according to the first embodiment includes the photosensitive members 50 capable of inhibiting occurrence of a ghost image. It is therefore possible to inhibit occurrence of a ghost image even if an image is formed using the image forming apparatus 1 including the primary transfer rollers 53 under constant-voltage control. In the image forming apparatus 1 including the primary transfer rollers 53 under constant-voltage control, the number of constant voltage sources 57 can be smaller than the number of primary transfer rollers 53. Thus, the image forming apparatus 1 can be simplified and miniaturized.

In order to perform stable primary transfer of the toners T from the primary transfer rollers 53 to the transfer belt 33, the current (transfer current) flowing through the primary transfer rollers 53 during application of the transfer voltage is preferably at least −20 μA and no greater than −10 μA.

<Static Elimination Lamp>

The static elimination lamps 54 are located downstream of the respective primary transfer rollers 53 in the rotation direction r of the photosensitive members 50. The cleaners 55 are located downstream of the respective static elimination lamps 54 in the rotation direction r of the photosensitive members 50. The charging rollers 51 are located downstream of the respective cleaners 55 in the rotation direction r of the photosensitive members 50. Since each static elimination lamp 54 is located between the corresponding primary transfer roller 53 and the corresponding cleaner 55, it is ensured that a time from static elimination of the circumferential surface 50*a* of the corresponding photosensitive member 50 by the static elimination lamp 54 to charging of the circumferential surface 50*a* of the photosensitive member 50 by the corresponding charging roller 51 (also referred to below as a static elimination-charging time) is sufficiently long. Thus, a time for eliminating excited carriers generated within the photosensitive layer 502 is ensured. The static elimination-charging time is preferably at least 20 milliseconds, and more preferably at least 50 milliseconds.

The static elimination light intensity of the static elimination lamps 54 is preferably at least 0 μJ/cm$^2$ and no greater than 10 μJ/cm$^2$, and more preferably at least 0 μJ/cm$^2$ and no greater than 5 μJ/cm$^2$. As a result of the static elimination light intensity of the static elimination lamps 54 being no greater than 10 μJ/cm$^2$, the amount of charge trapped in the photosensitive layers 502 of the photosensitive members 50 is reduced, improving chargeability of the photosensitive members 50. Preferably, the static elimination light intensity of the static elimination lamps 54 is as low as possible. Note that the static elimination light intensity of the static elimination lamps 54 being 0 μJ/cm$^2$ means a static eliminationless system, which is a system without static elimination of the photosensitive members 50 by the static elimination lamps 54. The static elimination light intensity of the static elimination lamps 54 can be measured according to a method described in association with Examples.

<Cleaner>

Each of the cleaners 55 includes the cleaning blade 81 and a toner seal 82. The cleaning blade 81 is located downstream of the corresponding primary transfer roller 53 in the rotation direction r of the corresponding photosensitive member 50. The cleaning blade 81 is pressed against the circumferential surface 50*a* of the photosensitive member 50 and collects residual toner T on the circumferential surface 50*a* of the photosensitive member 50. The residual toner T refers to the toner T remaining on the circumferential surface 50*a* of the photosensitive member 50 after primary transfer. Specifically, a distal end of the cleaning blade 81 is pressed against the circumferential surface 50*a* of the photosensitive member 50, and a direction from a proximal end to the distal end of the cleaning blade 81 is opposite to the rotation direction r at a point of contact between the distal end of the cleaning blade 81 and the circumferential surface 50*a* of the photosensitive member 50. The cleaning blade 81 is in counter-contact with the circumferential surface 50*a* of the photosensitive member 50. Thus, the cleaning blade 81 is tightly pressed against the circumferential surface 50*a* of the photosensitive member 50 such that the cleaning blade 81 digs into the photosensitive member 50 as the photosensitive member 50 rotates. Insufficient cleaning can be further prevented the toner from escaping capture by the cleaning bladeg blade 81 being tightly pressed against the circumferential surface 50*a* of the photosensitive member 50. The cleaning blade 81 is for example a plate-shaped elastic member. More specifically, the cleaning blade 81 is plate-shaped rubber. The cleaning blade 81 is in line-contact with the circumferential surface 50*a* of the photosensitive member 50.

The linear pressure N of the cleaning blade 81 on the circumferential surface 50*a* of the photosensitive member 50 is at least 14 N/m and no greater than 40 N/m. As a result of the linear pressure N of the cleaning blade 81 on the circumferential surface 50*a* of the photosensitive member 50 being at least 14 N/m, insufficient cleaning can be prevented. As a result of the linear pressure N of the cleaning blade 81 on the circumferential surface 50*a* of the photosensitive member 50 being no greater than 40 N/m, occurrence of a ghost image can be inhibited. In order to particularly prevent insufficient cleaning while inhibiting occurrence of a ghost image, the linear pressure N of the cleaning blade 81 on the circumferential surface 50*a* of the photosensitive member 50 is preferably at least 15 N/m and no greater than 40 N/m, more preferably at least 20 N/m and no greater than 40 N/m, still more preferably at least 25 N/m and no greater than 40 N/m, further preferably at least 30 N/m and no greater than 40 N/m, and particularly preferably at least 35 N/m and no greater than 40 N/m. The linear pressure N of the cleaning blade 81 on the circumferential surface 50*a* of the photosensitive member 50 may be in a range of two values selected from 14 N/m, 15 N/m, 20 N/m, 25 N/m, 30 N/m, 35 N/m, and 40 N/m.

The rebound resilience R of the cleaning blade 81 at a temperature of 25° C. is at least 38%. Typically, the lower the rebound resilience R of the cleaning blade 81 (for example, less than 35%) is, the less easily the external additive of the toner T passes through the gap between the cleaning blade 81 and the circumferential surface 50*a* of the photosensitive member 50 and the less easily a dash mark occurs. The reason for the above is that stick-slip motion of the distal end of the cleaning blade 81 is inhibited. However, the first embodiment allows the linear pressure N to be set high by the photosensitive member 50 satisfying mathematical formula (1B). Setting the linear pressure N high can favorably prevent the external additive of the toner T from passing through the gap between the circumferential surface 50*a* of the photosensitive member 50 and the cleaning blade 81 even in the case of the cleaning blade 81 having a high rebound resilience R at a temperature of 25° C. (for example, at least 38%). Reduction in amount of the external additive passing therethrough can inhibit occurrence of a dash mark due to fusion of the external additive into the circumferential surface 50*a* of the photosensitive member 50.

Typically, direct discharging or proximity discharging by a charging roller on a photosensitive member may generate a discharge product in air. When the discharge product adheres to a toner, the toner tends to easily fuse into the photosensitive member. Tendency of the toner having the discharge product adhering thereto to fuse into the photosensitive member increases with an increase in rebound resilience R of a cleaning blade (for example, at least 38%). However, the photosensitive member 50 satisfies the mathematical formula (1B) in the first embodiment, and accordingly, the amount of charge supplied from the charging roller 51 can be set small, reducing an amount of a discharge product to be generated. Therefore, even in a configuration in which the rebound resilience R of the cleaning blade 81 at a temperature of 25° C. is at least 38%, the toner T hardly fuses into the photosensitive member 50, inhibiting occurrence of a dash mark.

Furthermore, the higher the rebound resilience R of the cleaning blade 81 at a temperature of 25° C. is, the more insufficient cleaning can be prevented. Thus, as a result of the rebound resilience R of the cleaning blade 81 at a temperature of 25° C. being at least 38%, insufficient cleaning can be prevented.

Although no specific limitations are place on an upper limit of the rebound resilience R of the cleaning blade 81, the rebound rate R of the cleaning blade 81 can be set for example to no greater than 60%. The rebound resilience R of the cleaning blade 81 may be in a range of two values selected from 38%, 40%, 45%, 50%, 55%, and 60%. The rebound resilience R of the cleaning blade 81 can be measured according to a method described in association with Examples.

The linear pressure N of the cleaning blade 81 on the circumferential surface 50*a* of the photosensitive member 50 and the rebound resilience R of the cleaning blade 81 at a temperature of 25° C. satisfy the following mathematical formula (1A). As a result of mathematical formula (1A) being satisfied, occurrence of a dash mark can be inhibited.

$$R<13.771\times N^{0.4043} \quad (1A)$$

The cleaning blade 81 preferably has a hardness of at least 60 and no greater than 80, and more preferably at least 70 and no greater than 78. As a result of the hardness of the cleaning blade 81 being at least 60, the cleaning blade 81 is not too soft, favorably preventing insufficient cleaning. As a result of the hardness of the cleaning blade 81 being no greater than 80, the cleaning blade 81 is not too hard, reducing the abrasion amount of the photosensitive layer 502 of the photosensitive member 50. The hardness of the cleaning blade 81 can be measured according to a method described in association with Examples.

The toner seal 82 is located in contact with the circumferential surface 50*a* of the photosensitive member 50 between the corresponding primary transfer roller 53 and the cleaning blade 81, and prevents the toner T collected by the cleaning blade 81 from scattering.

<Thrust Mechanism>

Figure 9:
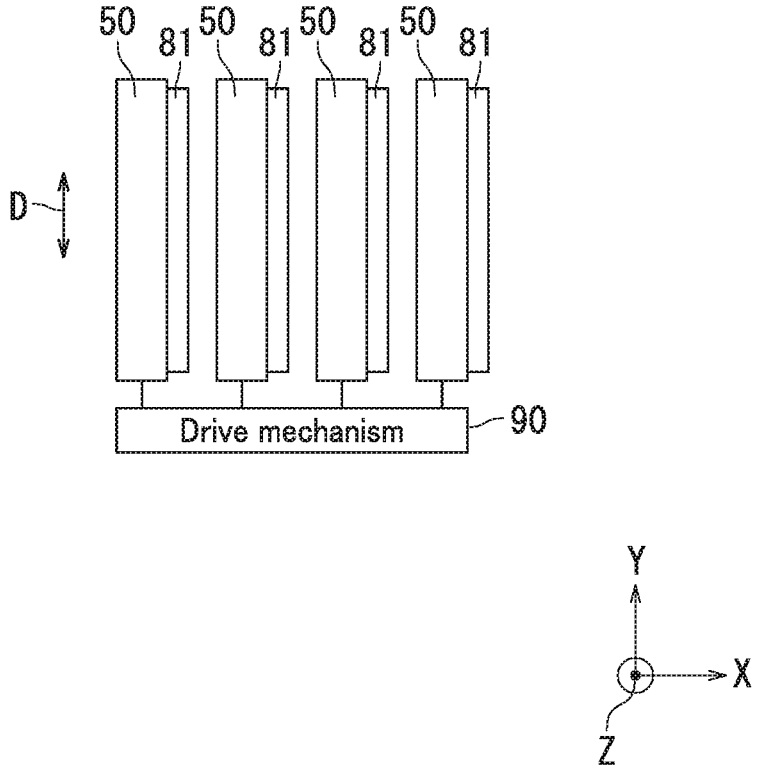
FIG. 9 is a diagram illustrating a drive mechanism for implementing a thrust mechanism.

The following describes a drive mechanism 90 for implementing a thrust mechanism with reference to FIG. 9. FIG. 9 is a plan view illustrating the photosensitive members 50, the cleaning blades 81, and the drive mechanism 90. Each of the photosensitive members 50 has a circular tubular shape elongated in a rotational axis direction D of the photosensitive member 50. Each of the cleaning blades 81 has a plate-like shape elongated in the rotational axis direction D.

The image forming apparatus 1 further includes the drive mechanism 90. The drive mechanism 90 causes either the photosensitive members 50 or the cleaning blades 81 to reciprocate in the rotational axis direction D. In the first embodiment, the drive mechanism 90 causes the photosensitive members 50 to reciprocate in the rotational axis direction D. The drive mechanism 90 for example includes a drive source such as a motor, a gear train, a plurality of cams, and a plurality of elastic members. The cleaning blades 81 are fixed to a housing of the image forming apparatus 1.

According to the first embodiment, as described with reference to FIG. 9, the photosensitive members 50 are caused to reciprocate in the rotational axis direction D against the cleaning blades 81. Accordingly, local accumulation on and around the edge of each cleaning blade 81 can be moved in the rotational axis direction D, preventing a scratch in a circumferential direction (referred to below as "a circumferential scratch") from occurring on the circumferential surface 50*a* of the corresponding photosensitive member 50. As a result, a streak that may occur in output images due to the toner T stuck in such a circumferential scratch is prevented. Thus, good quality of output images can be maintained over a long period of time.

Furthermore, according to the first embodiment in which the photosensitive members 50 are caused to reciprocate, it is easy to obtain driving force required for the reciprocation and restrict occurrence of toner leakage over opposite ends of each of the cleaning blades 81, compared to a configuration in which the cleaning blades 81 are caused to reciprocate.

The thrust amount of each photosensitive member 50 refers to a distance by which the photosensitive member 50 travels in one way of one back-and-forth motion. Note that in the first embodiment, an outward thrust amount and a return thrust amount are the same. The thrust amount of the photosensitive member 50 is preferably at least 0.1 mm and no greater than 2.0 mm, and more preferably at least 0.5 mm and no greater than 1.0 mm. As a result of the thrust amount of the photosensitive members 50 being within the above-specified range, occurrence of a circumferential scratch on the photosensitive member 50 can be favorably prevented.

The thrust period of each photosensitive member 50 refers to a time taken by the photosensitive member 50 to make one back-and-forth motion. In the present specification, the thrust period of the photosensitive member 50 is indicated by the number of rotations of the photosensitive member 50 per back-and-forth motion of the photosensitive member 50. The rotation speed of the photosensitive member 50 is constant. Accordingly, a longer thrust period of the photosensitive member 50 (i.e., more rotations of the photosensitive member 50 per back-and-forth motion of the photosensitive member 50) means that the photosensitive member 50 reciprocates more slowly. A shorter thrust period of the photosensitive member 50 (i.e., fewer rotations of the photosensitive member 50 per back-and-forth motion of the photosensitive member 50) means that the photosensitive member 50 reciprocates faster.

The thrust period of the photosensitive member 50 is preferably at least 10 rotations and no greater than 200 rotations, and more preferably at least 50 rotations and no greater than 100 rotations. As a result of the thrust period of the photosensitive member 50 being at least 10 rotations, it is easy to clean the circumferential surface 50*a* of the photosensitive member 50. Furthermore, as a result of the thrust period of the photosensitive member 50 being at least 10 rotations, the color image forming apparatus 1 tends not to undergo unintended coloristic shift. As a result of the thrust period of the photosensitive member 50 being no greater than 200 rotations, occurrence of a circumferential scratch on the photosensitive member 50 can be prevented.

Through the above, the image forming apparatus 1 according to the first embodiment has been described. Although a configuration has been described in which the charging rollers 51 are employed as chargers, the image forming apparatus 1 may have a configuration in which the chargers are charging brushes located in contact with or adjacent to the circumferential surfaces 50*a* of the respective photosensitive members 50. Although the chargers adopting a direct discharge process or a proximity discharge process (specifically, the charging rollers 51) have been described, the present disclosure is also applicable to chargers adopting a discharge process other than the direct discharge process and the proximity discharge process. Although a configuration in which the charging voltage is a direct current voltage has been described, the present disclosure is also applicable to a configuration in which the charging voltage is an alternating current voltage or a composite voltage. The composite voltage refers to a voltage of an alternating current voltage superimposed on a direct current voltage. Although the development rollers 52 each using a two-component developer containing the carrier CA and the toner T have been described, the present disclosure is also applicable to development devices each using a one-component developer. Although the image forming apparatus 1 adopting an intermediate transfer process has been described, the present disclosure is also applicable to an image forming apparatus adopting a direct transfer process.

Image Forming Method Implemented by Image Forming Apparatus According to First Embodiment The following describes an image forming method that is implemented by the image forming apparatus 1 according to the first embodiment. The image forming method includes charging and cleaning. In the charging, each charging roller 51 charges the circumferential surface 50*a* of the corresponding photosensitive member 50 to a positive polarity. In the cleaning, the toner T remaining on the circumferential surface 50*a* of the photosensitive member 50 is collected through the cleaning blade 81 being pressed against the circumferential surface 50*a* of the photosensitive member 50. The linear pressure N of the cleaning blade 81 on the circumferential surface 50*a* of the photosensitive member 50 is at least 14 N/m and no greater than 40 N/m. The rebound resilience R of the cleaning blade 81 at a temperature of 25° C. is at least 35%. The linear pressure N and the rebound resilience R satisfy mathematical formula (1A) described above. The photosensitive member 50 includes the conductive substrate 501 and the single-layer photosensitive layer 502. The photosensitive layer 502 contains a charge generating material, a hole transport material, an electron transport material, and a binder resin. The photosensitive member 50 satisfies mathematical formula (1B) described above. The image forming method that is implemented by the image forming apparatus 1 according to the first embodiment can inhibit occurrence of a ghost image, prevent insufficient cleaning, and inhibit occurrence of a dash mark.

Image Forming Apparatus and Image Forming Method According to Second Embodiment The following describes an image forming apparatus according to a second embodiment. The image forming apparatus according to the second embodiment includes an image bearing member, a charger that charges a circumferential surface of the image bearing member to a positive polarity, and a cleaning member that is pressed against the circumferential surface of the image bearing member and collects a toner remaining on the circumferential surface of the image bearing member. A linear pressure N of the cleaning member on the circumferential surface of the image bearing member is at least 14 N/m and no greater than 40 N/m. A rebound resilience R of the cleaning blade at a temperature of 25° C. is at least 38%. The linear pressure N and the rebound resilience R satisfy mathematical formula (1A) described in the first embodiment. The image bearing member includes a conductive substrate and a single-layer photosensitive layer. The single-layer photosensitive layer contains a charge generating material, a hole transport material, an electron transport material, and a binder resin. The charge generating material is contained in an amount of greater than 0.0% by mass and no greater than 0.5% by mass relative to mass of the photosensitive layer. Note that with respect to the image bearing member of the image forming apparatus according to the second embodiment, no limitations are placed on values related to mathematical formula (1B). The same description and preferred examples given with respect to the image forming apparatus according to the first embodiment apply to the image forming apparatus according to the second embodiment except values related to mathematical formula (1B) for the image bearing member. From the above, the image forming apparatus according to the second embodiment can inhibit occurrence of a ghost image, prevent insufficient cleaning, and inhibit occurrence of a dash mark.

The following describes an image forming method that is implemented by the image forming apparatus according to the second embodiment. This image forming method includes charging the circumferential surface of the image bearing member to a positive polarity and cleaning by collecting the toner remaining on the circumferential surface of the image bearing member through the cleaning member being pressed against the circumferential surface of the image bearing member. The linear pressure N of the cleaning member on the circumferential surface of the image bearing member is at least 14 N/m and no greater than 40 N/m. The rebound resilience R of the cleaning member at a temperature of 25° C. is at least 38%. The linear pressure N and the rebound resilience R satisfy mathematical formula (1A) described in the first embodiment. The image bearing member includes the conductive substrate and the single-layer photosensitive layer. The single-layer photosensitive layer contains a charge generating material, a hole transport material, an electron transport material, and a binder resin. The charge generating material is contained in an amount of greater than 0.0% by mass and no greater than 0.5% by mass relative to mass of the photosensitive layer. Note that with respect to the image forming method that is implemented by the image forming apparatus according to the second embodiment, no limitations are placed on values related to mathematical formula (1B). From the above, the image forming method implemented by the image forming apparatus according to the second embodiment can inhibit occurrence of a ghost image, prevent insufficient cleaning, and inhibit occurrence of a dash mark.

Image Forming Apparatus and Image Forming Method According to Third Embodiment The following describes an image forming apparatus according to a third embodiment. The image forming apparatus according to the third embodiment includes an image bearing member, a charger that charges a circumferential surface of the image bearing member to a positive polarity, and a cleaning member that is pressed against the circumferential surface of the image bearing member and collects a toner remaining on the circumferential surface of the image bearing member. A linear pressure N of the cleaning member on the circumferential surface of the image bearing member is at least 14 N/m and no greater than 40 N/m. A rebound resilience R of the cleaning blade at a temperature of 25° C. is at least 38%. The linear pressure N and the rebound resilience R satisfy mathematical formula (1A) described in the first embodiment. The image bearing member includes a conductive substrate and a single-layer photosensitive layer. The single-layer photosensitive layer contains a charge generating material, a hole transport material, an electron transport material, and a binder resin. The charge generating material is contained in an amount of greater than 0.0% by mass and no greater than 1.0% by mass relative to mass of the photosensitive layer. The photosensitive layer may contain no additive (40) or may further contain the additive (40) in an amount of greater than 0.0% by mass and no greater than 1.0% by mass relative to the mass of the photosensitive layer. Note that with respect to the image forming apparatus according to the third embodiment, no limitations are placed on values related to mathematical formula (1B) for the image bearing member. The same description and preferred examples given with respect to the image forming apparatus according to the first embodiment apply to the image forming apparatus according to the third embodiment except values related to mathematical formula (1B) for the image bearing member. From the above, the image forming apparatus according to the third embodiment can inhibit occurrence of a ghost image, prevent insufficient cleaning, and inhibit occurrence of a dash mark.

The following describes an image forming method that is implemented by the image forming apparatus according to the third embodiment. This image forming method includes charging the circumferential surface of the image bearing member to a positive polarity and cleaning by collecting the toner remaining on the circumferential surface of the image bearing member through the cleaning member being pressed against the circumferential surface of the image bearing member. The linear pressure N of the cleaning member on the circumferential surface of the image bearing member is at least 14 N/m and no greater than 40 N/m. The rebound resilience R of the cleaning blade at a temperature of 25° C. is at least 38%. The linear pressure N and the rebound resilience R satisfy mathematical formula (1A) described in the first embodiment. The image bearing member includes the conductive substrate and the single-layer photosensitive layer. The single-layer photosensitive layer contains a charge generating material, a hole transport material, an electron transport material, and a binder resin. The charge generating material is contained in an amount of greater than 0.0% by mass and no greater than 1.0% by mass relative to mass of the photosensitive layer. The photosensitive layer may contain no additive (40) or may further contain the additive (40) in an amount of greater than 0.0% by mass and no greater than 1.0% by mass relative to the mass of the photosensitive layer. Note that with respect to the image forming method that is implemented by the image forming apparatus according to the third embodiment, no limitations are placed on values related to mathematical formula (1B). From the above, the image forming method implemented by the image forming apparatus according to the third embodiment can inhibit occurrence of a ghost image, prevent insufficient cleaning, and inhibit occurrence of a dash mark.

EXAMPLES

The following provides more specific description of the present disclosure through use of Examples. Note that the present disclosure is not limited to the scope of Examples.

<Measurement Method>

The following first describes methods for measuring physical properties in tests of Examples and Comparative Examples.

($D_{50}$ of Toner)

$D_{50}$ of a target toner was measured using a particle size distribution analyzer ("COULTER COUNTER MULTISIZER 3", product of Beckman Coulter, Inc.).

(Number Average Roundness of Toner)

The number average roundness of a target toner was measured using a flow particle imaging analyzer ("FPIA (registered Japanese trademark) 3000", product of Sysmex Corporation).

(Static Elimination Light Intensity)

An optical power meter ("OPTICAL POWER METER 3664", product of HIOKI E.E. CORPORATION) was embedded in a circumferential surface of a target photosensitive member in a position opposite to a static elimination lamp. Static elimination light having a wavelength of 660 nm was irradiated onto the photosensitive member using the static elimination lamp, and the intensity of the static elimination light at the circumferential surface of the photosensitive member was measured using the optical power meter.

(Linear Pressure of Cleaning Blade)

The linear pressure of a target cleaning blade was measured using a load cell ("LMA-A SMALL-SIZED COMPRESSION LOAD CELL", product of Kyowa Electronic Instruments Co., Ltd.). Specifically, the load cell was replaced with a photosensitive member in an evaluation apparatus such that the load cell was disposed in a position of contact between the cleaning blade and the circumferential surface of the photosensitive member. The angle of contact between the cleaning blade and the load cell was set to 23 degrees. The cleaning blade was pressed against the load cell. The linear pressure of the cleaning blade was measured using the load cell ten seconds after the start of the pressing. The thus measured linear pressure was taken to be the linear pressure of the cleaning blade.

(Hardness of Cleaning Blade)

The hardness of the cleaning blade was measured using a rubber hardness tester ("ASKER RUBBER HARDNESS TESTER Type A", product of KOBUNSHI KEIKI CO., LTD) by a method in accordance with JIS K 6301.

(Rebound Resilience of Cleaning Blade)

The rebound resilience of the cleaning blade was measured using a rebound resilience tester ("RT-90", product of KOBUNSHI KEIKI CO., LTD) by a method in accordance with JIS K 6255 (equivalent to ISO 4662). The rebound resilience was measured under environmental conditions of a temperature of 25° C. and a relative humidity of 50%.

<Evaluation Apparatus>

The following describes the evaluation apparatus used for the tests of Examples and Comparative Examples. The evaluation apparatus was a modified version of a multifunction peripheral ("TASKALFA 356Ci", product of KYOCERA Document Solutions Inc.). A configuration and settings of the evaluation apparatus were as follows.

Photosensitive member: positively chargeable single-layer OPC drum

Diameter of photosensitive member: 30 mm

Film thickness of photosensitive layer of photosensitive member: 30 μm

Linear velocity of photosensitive member: 250 mm/second

Thrust amount of photosensitive member: 0.8 mm

Thrust period of photosensitive member: 70 rotations/back-and-forth motion

Charger: charging roller

Charging voltage: direct current voltage of positive polarity

Material of charging roller: epichlorohydrin rubber with an ion conductor dispersed therein Diameter of charging roller: 12 mm Thickness of rubber-containing layer of charging roller: 3 mm Resistance of charging roller: 5.8 log Ω upon application of a charging voltage of +500 V Distance between charging roller and circumferential surface of photosensitive member:

0 μm (contact)

Effective charge length: 226 mm

Transfer process: intermediate transfer process

Transfer voltage: direct current voltage of negative polarity

Material of transfer belt: polyimide

Transfer width: 232 mm

Static elimination light intensity: 5 $\mu J/cm^2$

Static elimination-charging time: 125 milliseconds

Cleaner: counter-contact cleaning blade

Contact angle of cleaning blade: 23 degrees

Material of cleaning blade: polyurethane rubber

Hardness of cleaning blade: 70 degrees

Thickness of cleaning blade: 1.8 mm

Pressing method of cleaning blade: by fixing digging amount of cleaning blade in photosensitive member (fixed deflection)

Digging amount of cleaning blade in photosensitive member: value in range of from 0.8 mm to 1.5 mm (value varying depending on linear pressure of cleaning blade)

<Production of Photosensitive Member>

Photosensitive members according to Examples and Comparative Examples to be mounted in an image forming apparatus were produced. The photosensitive members were produced using materials and methods described below.

A charge generating material, a hole transport material, electron transport materials, a binder resin, and an additive described below were prepared as materials of photosensitive layers of the photosensitive members.

(Charge Generating Material)

The Y-form titanyl phthalocyanine represented by chemical formula (CGM-1) described in association with the first embodiment was prepared as the charge generating material. This Y-form titanyl phthalocyanine did not exhibit a peak in a range of from 50° C. to 270° C. and exhibited a peak in a range of higher than 270° C. and no higher than 400° C. (specifically, a single peak at 296° C.) in a differential scanning calorimetry spectrum thereof, other than a peak resulting from vaporization of adsorbed water.

(Hole Transport Material)

The hole transport material (HTM-1) described in association with the first embodiment was prepared as the hole transport material.

(Electron Transport Material)

The electron transport materials (ETM-1) and (ETM-3) described in association with the first embodiment were prepared as the electron transport materials.

(Binder Resin)

The polyarylate resin (R-1) described in association with the first embodiment was prepared as the binder resin. The polyarylate resin (R-1) had a viscosity average molecular weight of 60,000.

(Additive)

The additive (40-1) described in association with the first embodiment was prepared as the additive.

(Production of Photosensitive Member (P-A1))

A vessel of a ball mill was charged with 1.0 part by mass of the Y-form titanyl phthalocyanine as the charge generating material, 20.0 parts by mass of the hole transport material (HTM-1), 12.0 parts by mass of the electron transport material (ETM-1), 12.0 parts by mass of the electron transport material (ETM-3), 55.0 parts by mass of the polyarylate resin (R-1) as the binder resin, and tetrahydrofuran as a solvent. The vessel contents were mixed for 50 hours using the ball mill to disperse the materials (the charge generating material, the hole transport material, the electron transport materials, and the binder resin) in the solvent. Through the above, an application liquid for photosensitive layer formation was obtained. The application liquid for photosensitive layer formation was applied onto a conductive substrate—an aluminum drum-shaped support—by dip coating to form a liquid film. The liquid film was hot-air dried at 100° C. for 40 minutes. Through the above, a single-layer photosensitive layer (film thickness: 30 μm) was formed on the conductive substrate. As a result, a photosensitive member (P-A1) was obtained.

(Production of Photosensitive Members (P-A2) and (P-B1))

Each of photosensitive members (P-A2) and (P-B1) was produced according to the same method as in the production of the photosensitive member (P-A1) in all aspects other than that the charge generating material in an amount specified in Table 4 was used, the hole transport material in an amount specified in Table 4 was used, the electron transport material(s) of type and in an amount specified in Table 4 was used, and the binder resin in an amount specified in Table 4 was used.

(Production of Photosensitive Members (P-A3) and (P-B2))

Each of photosensitive members (P-A3) and (P-B2) was produced according to the same method as in the production of the photosensitive member (P-A1) in all aspects other than that the additive of type and in an amount specified in Table 4 was added. The additive (40-1) was added in order to adjust chargeability of the photosensitive members.

<Measurement of Chargeability Ratio>

The chargeability ratio of each of the photosensitive members (P-A1) to (P-A3), (P-B1), and (P-B2) was measured according to the chargeability ratio measurement method described in association with the first embodiment. Table 4 shows measurement results of the chargeability ratio.

In Table 4, "wt %", "CGM", "HTM", "ETM", and "Resin" respectively mean "% by mass", "charge generating material", "hole transport material", "electron transport material", and "binder resin". In Table 4, "ETM-1/ETM-3" and "12.0/12.0" mean that both 12.0 parts by mass of the electron transport material (ETM-1) and 12.0 parts by mass of the electron transport material (ETM-3) were added. In Table 4, "–" means that the material was not contained. The amount of each material in Table 4 indicates a percentage (unit: % by mass) of the mass of the material relative to the mass of the photosensitive layer. The mass of the photosensitive layer is equivalent to the total mass of solids (more specifically, the charge generating material, the hole transport material, the electron transport material(s), the binder resin, and the additive) contained in the application liquid for photosensitive layer formation.

TABLE 4

| | CGM | | HTM | | ETM | | Resin | | Additive | | |
|---|---|---|---|---|---|---|---|---|---|---|---|
| Photosensitive member | Type | Amount [wt %] | Type | Amount [wt %] | Type | Amount [wt %] | Type | Amount [wt %] | Type | Amount [wt %] | Chargeability Ratio |
| P-B1 | CGM-1 | 1.7 | HTM-1 | 36.0 | ETM-1 | 23.0 | R-1 | 39.3 | — | — | 0.32 |
| P-B2 | CGM-1 | 1.0 | HTM-1 | 20.0 | ETM-1/ETM-3 | 12.0/12.0 | R-1 | 53.6 | 40-1 | 1.4 | 0.48 |
| P-A3 | CGM-1 | 1.0 | HTM-1 | 20.0 | ETM-1/ETM-3 | 12.0/12.0 | R-1 | 54.2 | 40-1 | 0.8 | 0.61 |
| P-A1 | CGM-1 | 1.0 | HTM-1 | 20.0 | ETM-1/ETM-3 | 12.0/12.0 | R-1 | 55.0 | — | — | 0.71 |
| P-A2 | CGM-1 | 0.5 | HTM-1 | 20.0 | ETM-1/ETM-3 | 12.0/12.0 | R-1 | 55.5 | — | — | 0.95 |

<Ghost Image Evaluation>

(Ghost Image Evaluation for Photosensitive Member (P-B1))

The photosensitive member (P-B1) was mounted in the evaluation apparatus. The transfer current of a primary transfer roller of the evaluation apparatus was set to −10 μA. The linear pressure of the cleaning blade of the evaluation apparatus was set to 20 N/m. The charging roller of the evaluation apparatus was used to charge the circumferential surface of the photosensitive member to a potential of +500V. The potential (+500 V) of the charged circumferential surface of the photosensitive member was taken to be a surface potential $V_A$ (unit: +V). Next, the primary transfer roller of the evaluation apparatus was used to apply a transfer voltage to the charged circumferential surface of the photosensitive member. The potential (surface potential $V_B$, unit: +V) of the circumferential surface of the photosensitive member after application of the transfer voltage was measured using a surface electrometer (not shown, "MODEL 344 ELECTROSTATIC VOLTMETER", product of TREK, INC.). A surface potential drop $\Delta V_{B-A}$ (unit: V) due to transfer was calculated from the thus measured surface potential $V_B$ in accordance with the following expression: "$\Delta V_{B-A}$=surface potential $V_B$−surface potential $V_A$=surface potential $V_B$−500".

Figure 10:
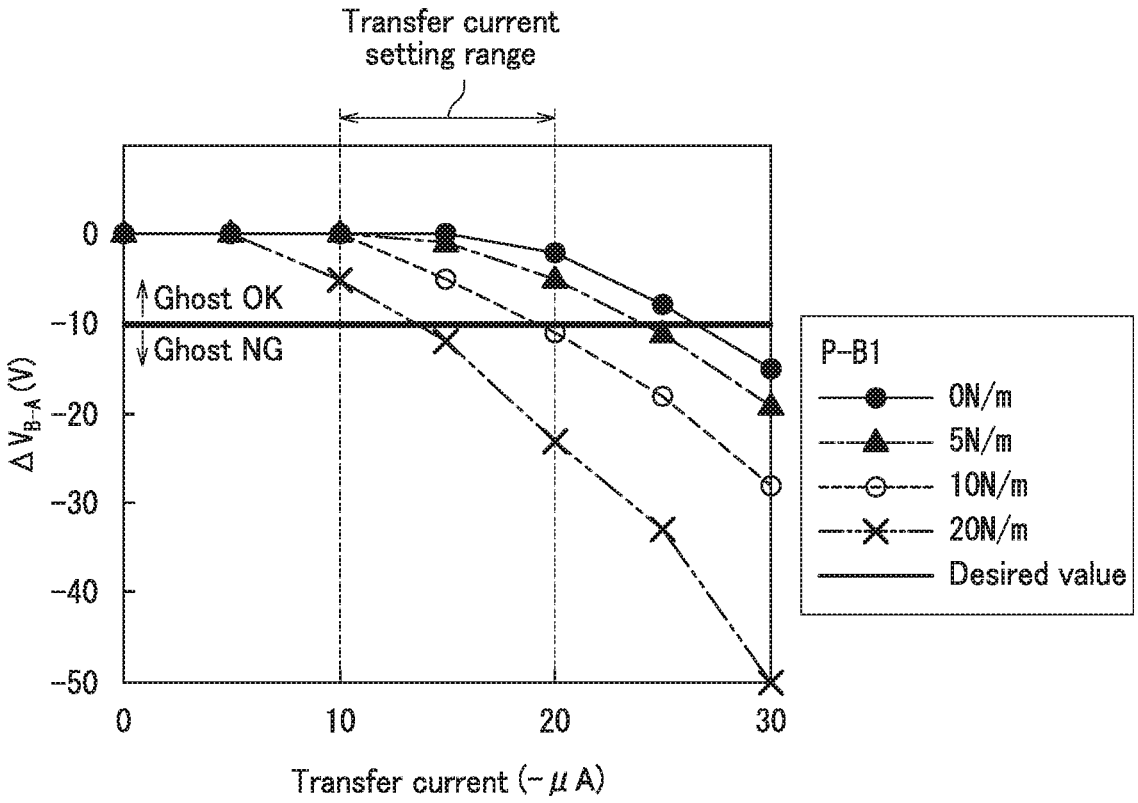
FIG. 10 is a graph representation illustrating a relationship between transfer current and surface potential drop due to transfer for a photosensitive member according to Comparative Example.

Next, the transfer current of the primary transfer roller of the evaluation apparatus was set to 0 μA, −5 μA, −15 μA, −20 μA, −25 μA, and −30 μA, and the surface potential drop $\Delta V_{B-A}$ (unit: V) due to transfer at each of these values of the transfer current was measured according to the same method as described above. Next, the linear pressure of the cleaning blade of the evaluation apparatus was set to 0 N/m, 5 N/m, and 10 N/m, and the surface potential drop $\Delta V_{B-A}$ (unit: V) due to transfer at each of these values of the linear pressure was measured according to the same method as described above. No transfer voltage was applied for a transfer current of 0 μA. The cleaning blade was removed from the evaluation apparatus for a linear pressure of the cleaning blade of 0 N/m. FIG. 10 shows measurement results of the surface potential drop $\Delta V_{B-A}$ (unit: V) due to transfer for the photosensitive member (P-B1).

(Ghost Image Evaluation for Photosensitive Member (P-A1))

Figure 11:
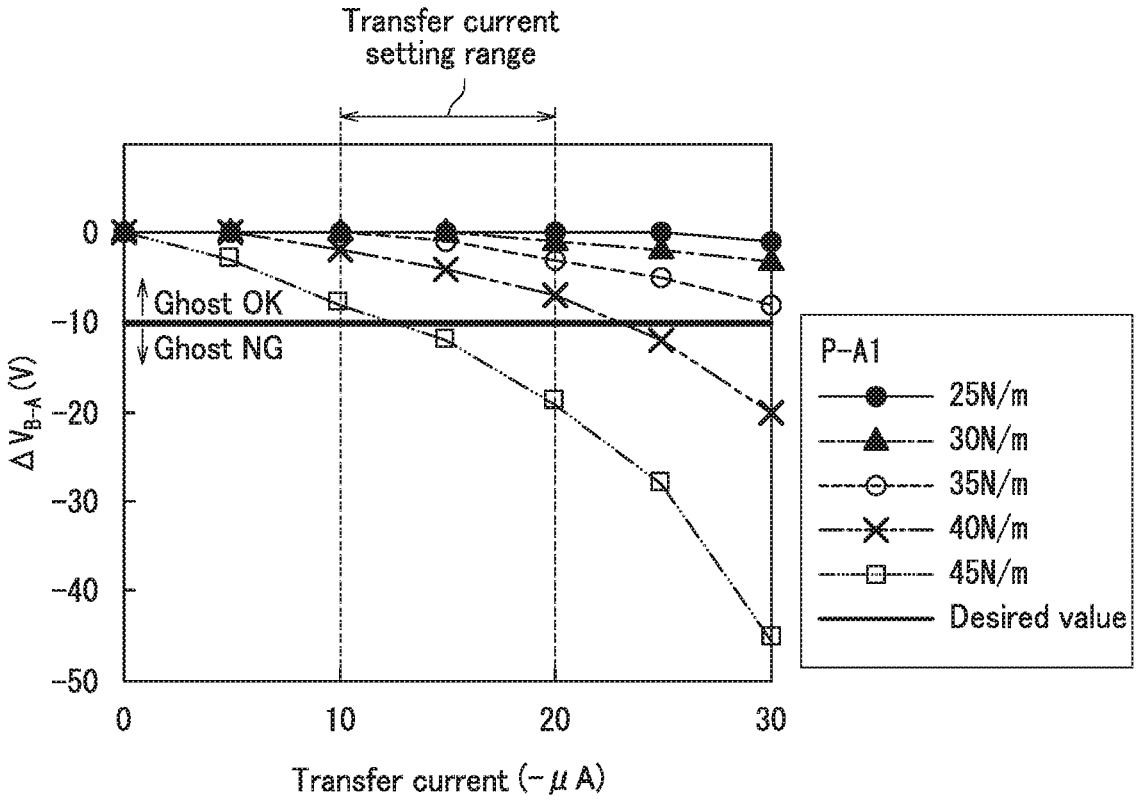
FIG. 11 is a graph representation illustrating a relationship between transfer current and surface potential drop due to transfer for a photosensitive member according to Example.

The photosensitive member (P-A1) was mounted in the evaluation apparatus. The surface potential drop $\Delta V_{B-A}$ (unit: V) due to transfer was measured for the photosensitive member (P-A1) according to the same method as in the ghost image evaluation for the photosensitive member (P-B1). Note that the transfer current of the primary transfer roller of the evaluation apparatus was set to 0 μA, −5 μA, −10 μA, −15 μA, −20 μA, −25 μA, and −30 μA, and the surface potential drop $\Delta V_{B-A}$ (unit: V) due to transfer at each of these values of the transfer current was measured. The linear pressure of the cleaning blade of the evaluation apparatus was set to 25 N/m, 30 N/m, 35 N/m, 40 N/m, and 45 N/m, and the surface potential drop $\Delta V_{B-A}$ (unit: V) due to transfer at each of these values of the linear pressure was measured. FIG. 11 shows measurement results of the surface potential drop $\Delta V_{B-A}$ (unit: V) due to transfer for the photosensitive member (P-A1).

(Ghost Image Evaluation Standard)

A ghost image tends to occur in an output image when an absolute value of the surface potential drop $\Delta V_{B-A}$ due to transfer is 10 V or greater. In order to perform stable primary transfer of the toner to the transfer belt, the transfer current is preferably set in a range (referred to below as a transfer current setting range) of at least −20 μA and no greater than −10 μA. Based on the above understanding, the photosensitive members were evaluated as being capable of inhibiting occurrence of a ghost image (denoted by "Ghost OK") if the absolute value of the surface potential drop $\Delta V_{B-A}$ due to transfer was less than 10 V with respect to all of set transfer current values of −20 μA, −15 μA, and −10 μA. The photosensitive members were evaluated as being incapable of inhibiting occurrence of a ghost image (denoted by "Ghost NG") if the absolute value of the surface potential drop $\Delta V_{B-A}$ due to transfer was 10 V or greater with respect to at least one of set transfer current values of −20 μA, −15 μA, and −10 μA.

(Ghost Image Evaluation Result)

As indicated in FIGS. 10 and 11, the absolute value of the surface potential drop $\Delta V_{B-A}$ due to transfer increased with an increase in the linear pressure of the cleaning blade. As also indicated in FIGS. 10 and 11, the absolute value of the surface potential drop $\Delta V_{B-A}$ due to transfer increased with a decrease (to be closer to −30 μA) in the transfer current.

FIG. 10 indicates the following about the photosensitive member (P-B1) having a chargeability ratio of lower than 0.60. As for the photosensitive member (P-B1), as shown in FIG. 10, the absolute value of the surface potential drop $\Delta V_{B-A}$ due to transfer was 10 V or greater with respect to at least one of set transfer current values of −20 μA, −15 μA, and −10 μA when the linear pressure of the cleaning blade was set to 10 N/m or 20 N/m. The absolute value of the surface potential drop $\Delta V_{B-A}$ due to transfer increases with an increase in the linear pressure of the cleaning blade. Accordingly, as for the photosensitive member (P-B1), the absolute value of the surface potential drop $\Delta V_{B-A}$ due to transfer is expected to be 10 V or greater with respect to at least one of set transfer current values of −20 μA, −15 μA, and −10 μA also when the linear pressure of the cleaning blade is set to greater than 20 N/m. It is therefore decided that the photosensitive member (P-B1) having a chargeability ratio of lower than 0.60 is incapable of inhibiting occurrence of a ghost image when the linear pressure of the cleaning blade is at least 14 N/m and no greater than 40 N/m, and the transfer current of the primary transfer roller is at least −20 μA and no greater than −10 μA.

FIG. 11 indicates the following about the photosensitive member (P-A1) having a chargeability ratio of at least 0.60. As for the photosensitive member (P-A1), as shown in FIG. 11, the absolute value of the surface potential drop $\Delta V_{B-A}$ due to transfer was less than 10 V with respect to all of set transfer current values of −20 μA, −15 μA, and −10 μA when the linear pressure of the cleaning blade was set to 25 N/m, 30 N/m, 35 N/m, and 40 N/m. The absolute value of the surface potential drop $\Delta V_{B-A}$ due to transfer decreases with a decrease in the linear pressure of the cleaning blade. Accordingly, as for the photosensitive member (P-A1), the absolute value of the surface potential drop $\Delta V_{B-A}$ due to transfer is expected to be less than 10 V with respect to all of set transfer current values of −20 μA, −15 μA, and −10 μA also when the linear pressure of the cleaning blade is set to less than 25 N/m. It is therefore decided that the photosensitive member (P-A1) having a chargeability ratio of at least 0.60 is capable of inhibiting occurrence of a ghost image when the linear pressure of the cleaning blade is at least 14 N/m and no greater than 40 N/m, and the transfer current of the primary transfer roller is at least −20 μA and no greater than −10 μA.

<Relationship Between Chargeability Ratio of Photosensitive Member and Ghost Image Evaluation>

The photosensitive member (P-B1) was mounted in the evaluation apparatus. The transfer current of the primary transfer roller of the evaluation apparatus was set to −20 μA. The linear pressure of the cleaning blade of the evaluation apparatus was set to 40 N/m. The charging roller of the evaluation apparatus was used to charge the circumferential surface of the photosensitive member to a potential of +500V. The potential (+500 V) of the charged circumferential surface of the photosensitive member was taken to be the surface potential $V_A$ (unit: +V). Next, the primary transfer roller of the evaluation apparatus was used to apply a transfer voltage to the charged circumferential surface of the photosensitive member. The potential of the circumferential surface of the photosensitive member after application of the transfer voltage was measured using a surface electrometer (not shown, "MODEL 344 ELECTROSTATIC VOLTMETER", product of TREK, INC.) and taken to be the surface potential $V_B$ (unit: +V). The surface potential drop $\Delta V_{B-A}$ (unit: V) due to transfer was calculated from the thus measured surface potential $V_B$ in accordance with the following expression: "$\Delta V_{B-A}$=surface potential $V_B$−surface potential $V_A$=surface potential $V_B$−500". The photosensitive member (P-B1) was changed to the photosensitive members (P-A1), (P-A2), (P-A3), and (P-B2), and the surface potential drop $\Delta V_{B-A}$ due to transfer for each of the photosensitive members was measured according to the same method as described above.

Figure 12:
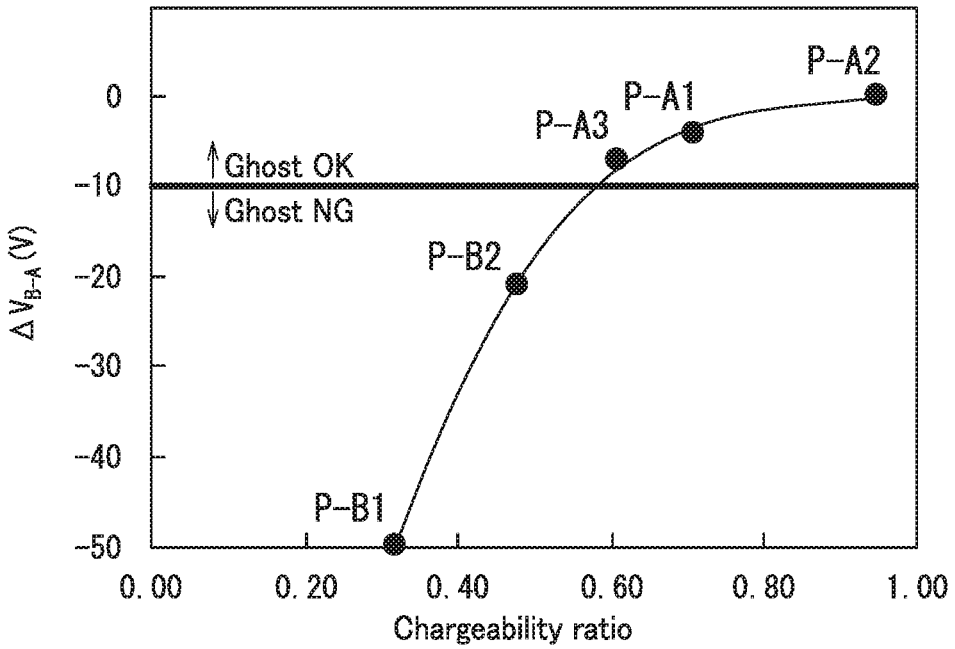
FIG. 12 is a graph representation illustrating a relationship between chargeability ratio and surface potential drop due to transfer for photosensitive members.

FIG. 12 shows measurement results of the surface potential drop $\Delta V_{B-A}$ due to transfer for the photosensitive members. The photosensitive members were evaluated as being capable of inhibiting occurrence of a ghost image (denoted by "Ghost OK") if the absolute value of the surface potential drop $\Delta V_{B-A}$ due to transfer was less than 10 V in FIG. 12. The photosensitive members were evaluated as being incapable of inhibiting occurrence of a ghost image (denoted by "Ghost NG") if the absolute value of the surface potential drop $\Delta V_{B-A}$ due to transfer was 10 V or greater in FIG. 12.

As for the photosensitive members (P-B1) and (P-B2) having a chargeability ratio of lower than 0.60, as shown in FIG. 12, the absolute value of the surface potential drop $\Delta V_{B-A}$ due to transfer was 10 V or greater. It is therefore decided that the photosensitive members (P-B1) and (P-B2) are incapable of inhibiting occurrence of a ghost image when used to form images. As for the photosensitive members (P-A1) to (P-A3) having a chargeability ratio of at least 0.60, as shown in FIG. 12, the absolute value of the surface potential drop $\Delta V_{B-A}$ due to transfer was less than 10 V. It is therefore decided that the photosensitive members (P-A1) to (P-A3) are capable of inhibiting occurrence of a ghost image when used to form images.

<Evaluation of Ghost Image Inhibition, Cleaning Ability, and Dash Mark Inhibition>

The photosensitive member (P-B1) was mounted in the evaluation apparatus. The evaluation apparatus was modified so as to increase an amount of paper dust entering the photosensitive member by removing a paper dust elimination mechanism mounted on a conveyance path of the evaluation apparatus from the evaluation apparatus. The transfer current of the primary transfer roller of the evaluation apparatus was set to −20 μA. A toner (number average roundness: 0.968, $D_{50}$: 6.8 μm) was loaded into a toner container of the evaluation apparatus, and a developer containing the toner and a carrier was loaded into a development device of the evaluation apparatus. Under environmental conditions of a temperature of 25° C. and a relative humidity of 50% RH, an image I (lateral band-shaped image having a coverage of 5%) was printed on successive 100,000 sheets of paper (A4 size) using the evaluation apparatus. The lateral band-shaped image was a rectangular solid image having a lateral dimension of 200 mm and a longitudinal dimension of 15 mm. Immediately after the 100,000-sheet printing, an image II was printed on a sheet of paper using the evaluation apparatus. The image II included an image area IIA located in a leading edge part of the paper in terms of a conveyance direction of the paper and an image area IIB located in a trailing edge part of the paper in terms of the conveyance direction of the paper. The image area IIA included a circular solid image portion and a background blank paper portion. The image area IIA corresponded to an image area formed in the first turn of the photosensitive member in formation of the image II. The image area IIB was constituted by a halftone image portion. The image area IIB corresponded to an image area formed in the second turn of the photosensitive member in formation of the image II.

(Evaluation of Cleaning Ability)

After the printing of the image I on the 100,000 sheets of paper and the printing of the image II on the one sheet, the circumferential surface of the photosensitive member was visually observed. Whether or not the toner that had escaped capture by the cleaning blade was present on the circumferential surface of the photosensitive member was checked. Then, cleaning ability was evaluated according to the following standards.

Good: No toner that had escaped capture by the cleaning blade was observed on the circumferential surface of the photosensitive member.

Poor: The toner that had escaped capture by the cleaning blade was observed on the circumferential surface of the photosensitive member.

Evaluation of cleaning ability was performed through the rebound resilience R of the cleaning blade being increased little by little from 10% with the linear pressure N of the cleaning blade set to 20 N/m. The highest rebound resilience R (an upper limit of rebound resilience at which insufficient cleaning occurs) of rebound resiliences R for which cleaning ability was evaluated as poor was obtained. The linear pressure N of the cleaning blade was set to 30 N/m or 40 N/m, and an upper limit of rebound resilience at which insufficient cleaning occurs at each linear pressure was obtained by the same method.

(Evaluation of Dash Mark Inhibition)

The halftone image portion of the printed image II was visually observed to check the presence or absence of a black dash mark in the halftone image portion. Whether or not occurrence of a dash mark had been inhibited was evaluated in accordance with the following standards.

Good: No dash mark was observed.

Poor: A dash mark was observed.

Evaluation of dash mark inhibition was performed through the rebound resilience R being decreased little by little from 60% with the linear pressure N of the cleaning blade set to 10 N/m. The lowest rebound resilience R (a lower limit of rebound resilience at which a dash mark occurs) of rebound resiliences R for which dash mark inhibition was evaluated as poor was obtained. The linear pressure N of the cleaning blade was set to 25 N/m, 30 N/m, or 40 N/m, and a lower limit of rebound resilience at which a dash mark occurs in each linear pressure was obtained by the same method.

(Evaluation of Ghost Image Inhibition)

The halftone image portion of the printed image II was visually observed to check the presence or absence of a ghost image in the halftone image portion. When a ghost image occurs, the ghost image (residual image) resulting from the circular solid image portion of the image I resulting from the circular solid image portion of the image II appears in the halftone image portion of the image II. Whether or not occurrence of a ghost image had been inhibited was evaluated according to the following standards.

Good: No ghost image was observed.

Poor: A ghost image was observed.

Evaluation of ghost image inhibition was performed through the rebound resilience R of the cleaning blade being increased little by little from 10% with the linear pressure N of the cleaning blade set to 20 N/m. The highest rebound resilience R (an upper limit of rebound resilience at which a ghost image occurs) of rebound resiliences R for which ghost image inhibition was evaluated as poor was obtained. The linear pressure N of the cleaning blade was set to 25 N/m, 40 N/m, or 45 N/m, and an upper limit of rebound resilience at which a ghost image occurs at each linear pressure was obtained by the same method.

Figure 13:
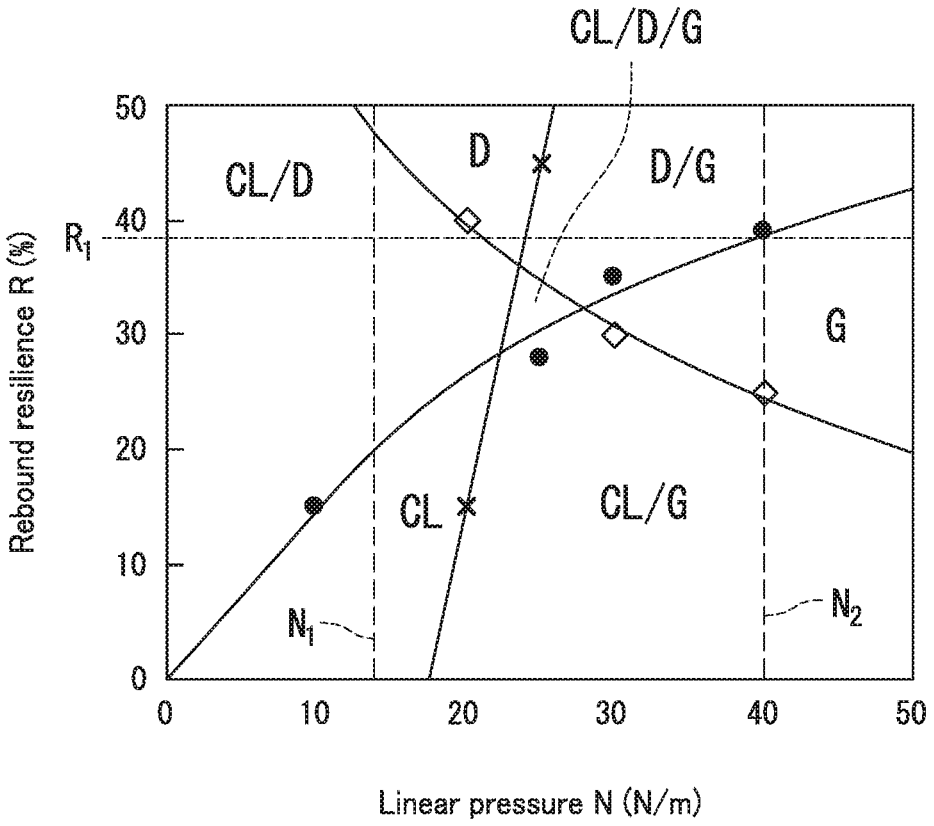
FIG. 13 is a graph representation illustrating a relationship between linear pressure and rebound resilience of a cleaning blade included in the photosensitive member according to Comparative Example.

FIG. 13 shows the upper limits of rebound resilience at which insufficient cleaning occurs, the lower limits of rebound resilience at which a dash mark occurs, and the upper limits of rebound resilience at which a ghost image occurs for the photosensitive member (P-B1). Diamonds on the plot in FIG. 13 each indicate an upper limit of rebound resilience at which insufficient cleaning occurs. Circles on the plot in FIG. 13 each indicate a lower limit of rebound resilience at which a dash mark occurs. Crosses on the plot in FIG. 13 each indicate an upper limit of rebound resilience at which a ghost image occurs.

Figure 14:
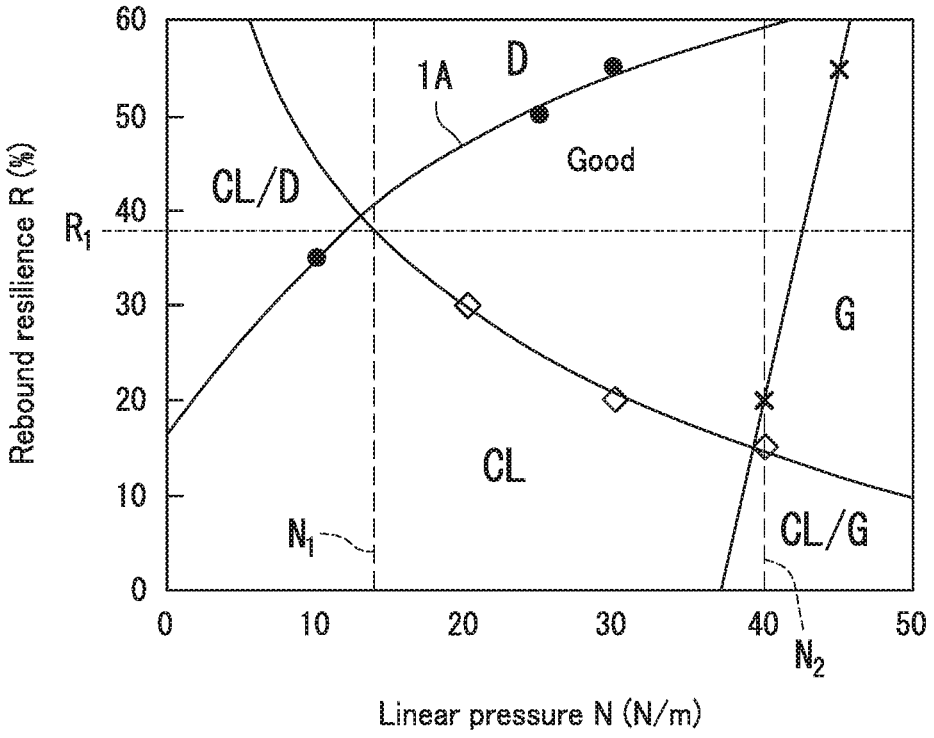
FIG. 14 is a graph representation illustrating a relationship between linear pressure and rebound resilience of a cleaning blade included in the photosensitive member according to Example.

Next, evaluation of ghost image inhibition, clearing ability, and dash mark inhibition was performed on the photosensitive member (P-A1) by the respective same methods as those performed on the photosensitive member (P-B1) in all aspects other than that the photosensitive member (P-B1) was changed to the photosensitive member (P-A1). FIG. 14 shows upper limits of rebound resilience at which insufficient cleaning occurs, lower limits of rebound resilience at which a dash mark occurs, and upper limits of rebound resilience at which a ghost image occurs for the photosensitive member (P-A1). Diamonds on the plot in FIG. 14 each indicate an upper limit of rebound resilience at which insufficient cleaning occurs. Circles on the plot in FIG. 14 each indicate a lower limit of rebound resilience at which a dash mark occurs. Crosses on the plot in FIG. 14 each indicate an upper limit of rebound resilience at which a ghost image occurs.

Note that in FIGS. 13 and 14, "$N_1$" represents a linear pressure of 14 N/m. "$N_2$" represents a linear pressure of 40 N/m, and "$R_1$" represents a rebound resilience of 38%. In FIGS. 13 and 14, "CL" represents a range in which cleaning ability was evaluated as poor. "D" represents a range in which dash mark inhibition was evaluated as poor. "G" represents a range in which ghost image inhibition was evaluated as poor. "CL/D" represents a range in which both cleaning ability and dash mark inhibition were evaluated as poor. "CL/G" represents a range in which both cleaning ability and ghost image inhibition were evaluated as poor. "D/G" represents a range in which both dash mark inhibition and ghost image inhibition were evaluated as poor. "CL/D/G" represents a range in which each of clearing ability, dash mark inhibition, and ghost image inhibition was evaluated as poor. "Good" in FIG. 14 represents a range in which all of clearing ability, dash mark inhibition, and ghost image inhibition were evaluated as good. A curve indicated by "1A" in FIG. 14 represents mathematical formula (1A).

For the photosensitive member (P-B1) having a chargeability ratio of less than 0.60, there was no range in which all of clearing ability, dash mark inhibition, and ghost image inhibition were evaluated as good as shown in FIG. 13.

For the photosensitive member (P-A1) having a chargeability ratio of at least 0.60, there was a wide range in which all of clearing ability, dash mark inhibition, and ghost image inhibition were evaluated as good as shown in FIG. 14. When the linear pressure N of the cleaning blade was at least 14 N/m and no greater than 40 N/m (at least $N_1$ and no greater than $N_2$ in FIG. 14), the rebound resilience R of the cleaning blade at a temperature of 25° C. was at least 38% (at least $R_1$ in FIG. 14), and the linear pressure N and the rebound resilience R satisfied mathematical formula (1A), all of clearing ability, dash mark inhibition, and ghost image inhibition were evaluated as good for the photosensitive member (P-A1).

<Abrasion Resistance Evaluation>

Figure 15:
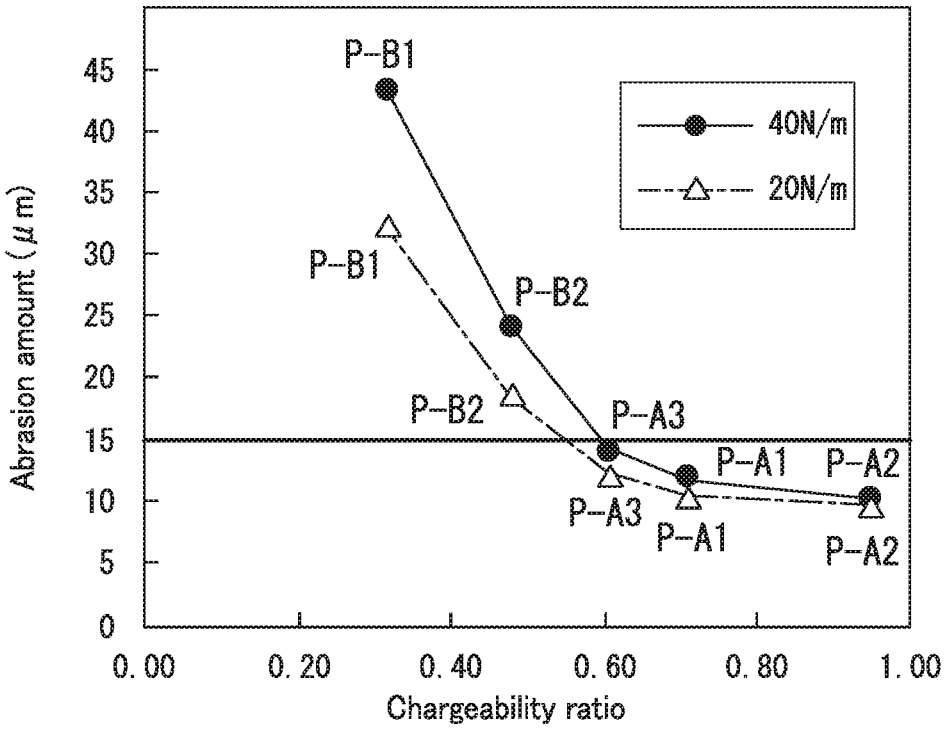
FIG. 15 is a graph representation illustrating a relationship between chargeability ratio and abrasion amount for photosensitive members.

Abrasion resistance of each of the photosensitive members (P-A1) to (P-A3), (P-B1), and (P-B2) was evaluated. Specifically, a film thickness $TH_1$ of the photosensitive layer of the photosensitive member was measured using a film thickness measuring device ("FISCHERSCOPE (registered Japanese trademark) MMS (registered Japanese trademark) ", product of Helmut Fischer). The photosensitive member was mounted in the evaluation apparatus, and the linear pressure of the cleaning blade was set to 40 N/m. A toner ($D_{50}$: 6.8 μm, number average roundness: 0.968) was loaded into a toner container of the evaluation apparatus, and a developer containing the toner and a carrier was loaded into a development device of the evaluation apparatus. The photosensitive member was caused to rotate 2,000,000 times while an image (a lateral band-shaped image having a coverage of 5%) was printed on successive sheets of paper (A4 size) using the evaluation apparatus and the cleaning blade was pressed against the photosensitive member. The lateral band-shaped image was a rectangular solid image having a lateral dimension of 200 mm and a longitudinal dimension of 15 mm. After the photosensitive member had completed 2,000,000 rotations, a film thickness $TH_2$ of the photosensitive layer of the photosensitive member was measured using the film thickness measuring device ("FISCHERSCOPE (registered Japanese trademark) MMS (registered Japanese trademark)", product of Helmut Fischer). The abrasion amount (unit: μm) of the photosensitive layer at a linear pressure of the cleaning blade of 40 N/m was calculated from the film thickness $TH_1$ and the film thickness $TH_2$ in accordance with the following expression: "Abrasion amount=film thickness $TH_1$−film thickness $TH_2$". Next, the linear pressure of the cleaning blade was changed to 20 N/m, and the abrasion amount (unit: μm) of the photosensitive layer at a linear pressure of the cleaning blade of 20 N/m was measured according to the same method as described above. FIG. 15 shows measurement results of the abrasion amount at linear pressures of the cleaning blade of 40 N/m and 20 N/m. The photosensitive members were evaluated as having good abrasion resistance if the abrasion amount was not greater than 15 μm. The photosensitive members were evaluated as having poor abrasion resistance if the abrasion amount was greater than 15 μm.

As for the photosensitive members (P-B1) and (P-B2) having a chargeability ratio of lower than 0.60, as shown in FIG. 15, the abrasion amount was greater than 15 μm, indicating poor abrasion resistance. As for the photosensitive members (P-A1) to (P-A3) having a chargeability ratio of at least 0.60, as shown in FIG. 15, the abrasion amount was not greater than 15 μm, indicating good abrasion resistance.

<Charging Roller Resistance Change Evaluation>

With respect to each of the photosensitive members (P-A1) to (P-A3), (P-B1), and (P-B2), the photosensitive member was mounted in the image forming apparatus, and change in resistance of a charging roller of the image forming apparatus was evaluated. The resistance of the charging roller was measured under environmental conditions of a temperature of 23° C. and a relative humidity of 53%. The resistance of the charging roller was measured using a jig. The jig included a metal roller for holding the charging roller, a voltage applicator for applying a voltage to the charging roller, and an ammeter for measuring the current flowing through the charging roller.

First, the charging roller was left to stand for 4 hours under environmental conditions of a temperature of 23° C. and a relative humidity of 53%. Thereafter, the charging roller was placed on the metal roller of the jig. A total load of 1 kgf was applied to the charging roller with a load of 500 gf to either end of the charging roller. While the load was applied, a charging voltage (charging bias) of +500 V was applied to a shaft of the charging roller using the voltage applicator of the jig. The current was measured using the ammeter three seconds after the application of the charging voltage. An initial resistance $RE_1$ (unit: log Ω) of the charging roller was calculated from the applied charging voltage (+500 V) and the measured current.

Next, the photosensitive member was mounted in the evaluation apparatus, and the linear pressure of the cleaning blade was set to 40 N/m. A toner ($D_{50}$: 6.8 μm, number average roundness: 0.968) was loaded into a toner container of the evaluation apparatus, and a developer containing the toner and a carrier was loaded into a development device of the evaluation apparatus. The photosensitive member was caused to rotate 100,000 times while an image (a lateral band-shaped image having a coverage of 5%) was printed on successive sheets of paper (A4 size) using the evaluation apparatus and the cleaning blade was pressed against the photosensitive member. Immediately after the photosensitive member had completed 100,000 rotations, the charging roller was placed on the metal roller of the jig. A total load of 1 kgf was applied to the charging roller with a load of 500 gf to either end of the charging roller. While the load was applied, a charging voltage (charging bias) of +500 V was applied to the shaft of the charging roller using the voltage applicator of the jig. The current was measured using the ammeter three seconds after the application of the charging voltage. A resistance $RE_2$ (unit: log Ω) of the charging roller after 100,000 rotation of the photosensitive member was calculated from the applied charging voltage (+500 V) and the measured current.

Figure 16:
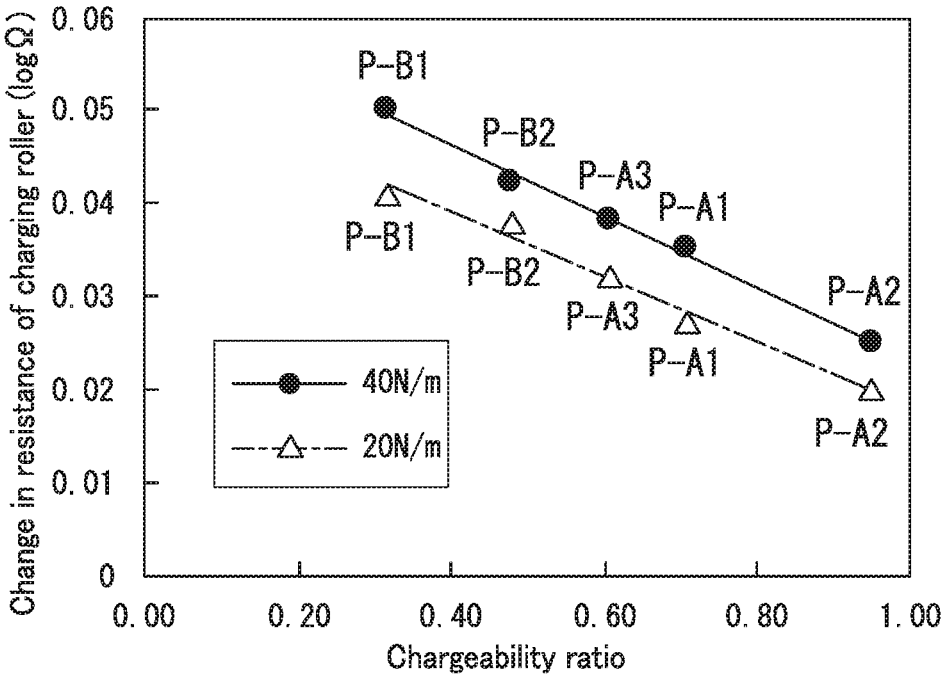
FIG. 16 is a graph representation illustrating a relationship between chargeability ratio of the photosensitive members and change in resistance of a charging roller.

A change (unit: log Ω) in resistance of the charging roller when the linear pressure of the cleaning blade was 40 N/m was calculated from the resistance $RE_1$ and the resistance $RE_2$ in accordance with the following expression: "Change in resistance=resistance $RE_2$−resistance $RE_1$". Next, the linear pressure of the cleaning blade was changed to 20 N/m, and a change (unit: log Ω) in resistance of the charging roller when the linear pressure of the cleaning blade was 20 N/m was measured according to the same method as described above. FIG. 16 shows measurement results of the change in resistance of the charging roller when the linear pressure of the cleaning blade was 40 N/m and 20 N/m.

As shown in FIG. 16, the change in resistance of the charging roller with respect to the same linear pressure of the cleaning blade was smaller when the image forming apparatus included any of the photosensitive members (P-A1) to (P-A3) having a chargeability ratio of at least 0.60 than when the image forming apparatus included the photosensitive member (P-B1) or (P-B2) having a chargeability ratio of lower than 0.60. The results have proved that the resistance of the charging roller of the image forming apparatus including any of the photosensitive members (P-A1) to (P-A3) tends not to elevate even if an image is continuously formed while the photosensitive member is rotating.

<Other Properties of Photosensitive Member>

With respect to each of the photosensitive members, surface friction coefficient, Martens hardness of the photosensitive layer, and sensitivity were measured.

(Surface Friction Coefficient of Circumferential Surface of Photosensitive Member)

A non-woven fabric ("KIMWIPE S-200", product of NIPPON PAPER CRECIA CO., LTD.) was placed on the circumferential surface of the photosensitive member, and a weight (load: 200 gf) was placed on the non-woven fabric. An area of contact between the weight and the circumferential surface of the photosensitive member with the non-woven fabric therebetween was 1 $cm^2$. The photosensitive member was caused to laterally slide at a rate of 50 mm/second while the weight was fixed. Lateral friction force in the lateral sliding was measured using a load cell ("LMA-A SMALL-SIZED COMPRESSION LOAD CELL", product of Kyowa Electronic Instruments Co., Ltd.). The surface friction coefficient of the circumferential surface of the photosensitive member was calculated in accordance with the following expression: "Surface friction coefficient=measured lateral friction force/200". The circumferential surfaces of the photosensitive members (P-A1) to (P-A3) had a surface friction coefficient of 0.45, a surface friction coefficient of 0.52, a surface friction coefficient of 0.50, respectively. The circumferential surfaces of the photosensitive members (P-B1) and (P-B2) had a surface friction coefficient of 0.55 and a surface friction coefficient of 0.53, respectively. That the circumferential surfaces of the photosensitive members (P-A1) to (P-A3) each had a smaller friction coefficient than the circumferential surfaces of the photosensitive members (P-B1) and (P-B2) can be thought as one of reasons why the photosensitive members (P-A1) to (P-A3) can prevent insufficient cleaning.

(Martens Hardness of Photosensitive Layer)

The Martens hardness of the photosensitive layer of the photosensitive member (P-A1) was measured using a hardness tester ("FISCHERSCOPE (registered Japanese trademark) HM2000XYp", product of Fischer Instruments K.K.) by a nanoindentation method in accordance with ISO 14577. The measurement was carried out as described below under environmental conditions of a temperature of 23° C. and a relative humidity of 50%. That is, a square pyramidal diamond indenter (opposite sides angled at 135 degrees) was brought into contact with the circumferential surface of the photosensitive layer, a load was gradually applied to the indenter at a rate of 10 mN/5 seconds, the load was retained for one second once the load reached 10 mN, and the load was removed five seconds after the retention. The thus measured Martens hardness of the photosensitive layer of the photosensitive member (P-A1) was 220 $N/mm^2$.

(Sensitivity of Photosensitive Member)

With respect to each of the photosensitive members (P-A1) to (P-A3), sensitivity was evaluated. Sensitivity was evaluated under environmental conditions of a temperature of 23° C. and a relative humidity of 50%. First, the circumferential surface of the photosensitive member was charged to +500 V using a drum sensitivity test device (product of Gen-Tech, Inc.). Next, monochromatic light (wavelength: 780 nm, half-width: 20 nm, light intensity: 1.0 $\mu J/cm^2$) was obtained from white light of a halogen lamp using a band-pass filter. The thus obtained monochromatic light was irradiated onto the circumferential surface of the photosensitive member. A surface potential of the circumferential surface of the photosensitive member was measured when 50 milliseconds elapsed from termination of irradiation. The thus measured surface potential was taken to be a post-irradiation potential (unit: +V). The photosensitive members (P-A1), (P-A2), and (P-A3) resulted in a post-irradiation potential of +110 V, a post-irradiation potential of +108 V, and a post-irradiation potential of +98 V, respectively.

These results demonstrate that the photosensitive members (P-A1) to (P-A3) each have a surface friction coefficient of the circumferential surface, a Martens hardness of the photosensitive layer, and sensitivity that are suitable for image formation.

Through the above, the image forming apparatus according to the present disclosure, which encompasses an image forming apparatus including any of the photosensitive members (P-A1) to (P-A3), was proven to be capable of inhibiting occurrence of a ghost image, preventing insufficient cleaning, and inhibiting occurrence of a dash mark. The image forming apparatus according to the present disclosure was also proven to be capable of improving abrasion resistance and reducing change in resistance of the charging roller in addition to inhibiting occurrence of a ghost image, preventing insufficient cleaning, and inhibiting occurrence of a dash mark.

What is claimed is:

1. An image forming apparatus comprising:

an image bearing member;

a charger configured to charge a circumferential surface of the image bearing member to a positive polarity; and a cleaning member pressed against the circumferential surface of the image bearing member and configured to collect a toner remaining on the circumferential surface of the image bearing member, wherein a linear pressure N of the cleaning member on the circumferential surface of the image bearing member is at least 14 N/m and no greater than 40 N/m, a rebound resilience R of the cleaning member at a temperature of 25° C. is at least 38%, the leaner pressure N and the rebound resilience R satisfy mathematical formula (1A), the image bearing member includes a conductive substrate and a single-layer photosensitive layer, the single-layer photosensitive layer contains a charge generating material, a hole transport material, an electron transport material, and a binder resin, and the image bearing member satisfies mathematical formula (1B), $$R < 13.771 \times N^{0.4043} \quad (1A)$$

$$0.60 \leqq \frac{V}{(Q/S) \times (d/\varepsilon_r \cdot \varepsilon_0)} \quad (1B)$$

where in mathematical formula (1B),

Q represents a charge amount of the image bearing member,

S represents a charge area of the image bearing member, d represents a film thickness of the single-layer photosensitive layer, $\varepsilon_r$ represents a specific permittivity of the binder resin contained in the single-layer photosensitive layer, $\varepsilon_0$ represents a vacuum permittivity, V is a value calculated in accordance with the following expression: $V=V_0-V_r$, $V_r$ represents a first potential of the circumferential surface of the image bearing member yet to be charged by the charger, and $V_0$ represents a second potential of the circumferential surface of the image bearing member charged by the charger.

2. The image forming apparatus according to claim 1, wherein the hole transport material includes a compound represented by general formula (10), (10)

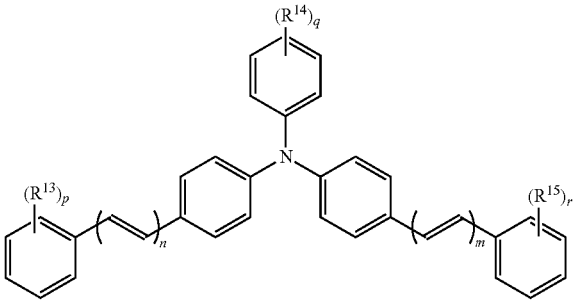

where in mathematical formula (10), $R^{13}$ to $R^{15}$ each represent, independently of one another, an alkyl group having a carbon number of at least 1 and no greater than 4 or an alkoxy group having a carbon number of at least 1 and no greater than 4, m and n each represent, independently of one another, an integer of at least 1 and no greater than 3, p and r each represent, independently of one another, 0 or 1, and q represents an integer of at least 0 and no greater than 2.

3. The image forming apparatus according to claim 1, wherein the hole transport material includes a compound represented by chemical formula (HTM-1)

(HTM-1)

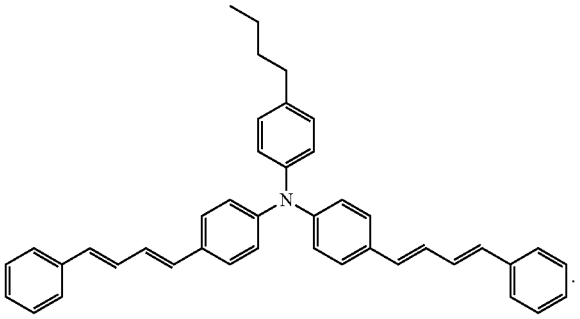

4. The image forming apparatus according to claim 1, wherein the binder resin includes a polyarylate resin including a repeating unit represented by general formula (20), (20)

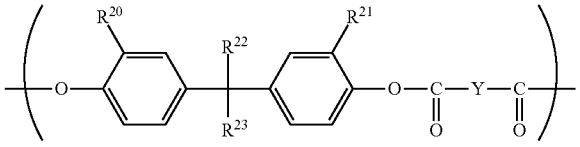

where in general formula (20), $R^{20}$ and $R^{21}$ each represent, independently of one another, a hydrogen atom or an alkyl group having a carbon number of at least 1 and no greater than 4, $R^{22}$ and $R^{23}$ each represent, independently of one another, a hydrogen atom, a phenyl group, or an alkyl group having a carbon number of at least 1 and no greater than 4, $R^{22}$ and $R^{23}$ may be bonded to one another to form a divalent group represented by general formula (W), and Y represents a divalent group represented by chemical formula (Y1), (Y2), (Y3), (Y4), (Y5), or (Y6), and (W)

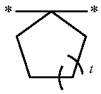

in general formula (W), t represents an integer of at least 1 and no greater than 3, and asterisks each represent a bond (Y1)

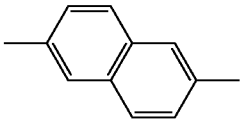

(Y2)

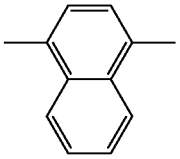

(Y3)

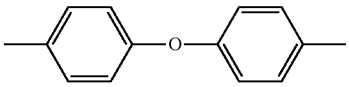

(Y4)

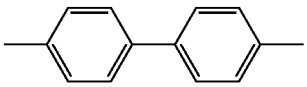

(Y5)

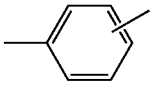

(Y6)

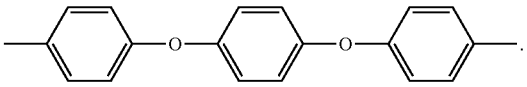

5. The image forming apparatus according to claim 1, wherein the binder resin includes a polyarylate resin having a main chain represented by general formula (20-1) and a terminal group represented by chemical formula (Z), (20-1)

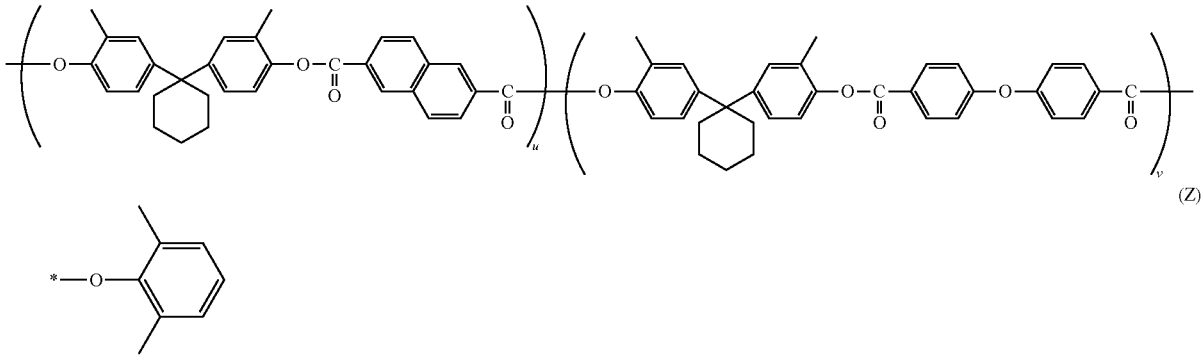

(Z)

where in general formula (20-1), a sum of u and v is 100, and u is a number greater than or equal to 30 and less than or equal to 70, and in chemical formula (Z), an asterisk represents a bond.

6. The image forming apparatus according to claim 1, wherein the electron transport material includes both a compound represented by general formula (31) and a compound represented by general formula (32), (31)

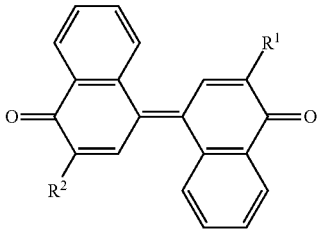

(32)

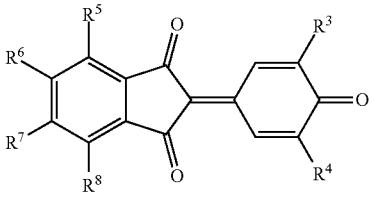

where in general formulae (31) and (32), $R^1$ to $R^4$ each represent, independently of one another, an alkyl group having a carbon number of at least 1 and no greater than 8, and $R^5$ to $R^8$ each represent, independently of one another, a hydrogen atom, a halogen atom, or an alkyl group having a carbon number of at least 1 and no greater than 4.

7. The image forming apparatus according to claim 1, wherein the electron transport material includes both a compound represented by chemical formula (ETM-1) and a compound represented by chemical formula (ETM-3)

(ETM-1)

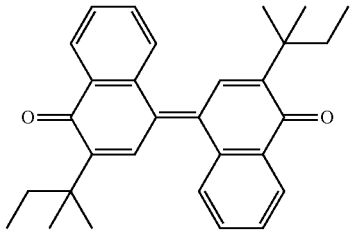

(ETM-3)

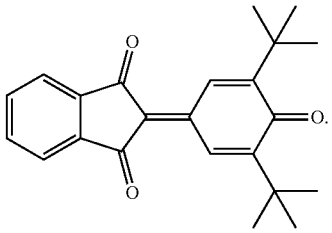

8. The image forming apparatus according to claim 1, wherein the single-layer photosensitive layer further contains a compound represented by general formula (40), and the compound represented by general formula (40) is contained in an amount of greater than 0.0% by mass and no greater than 1.0% by mass relative to mass of the single-layer photosensitive layer, $$R^{40}\text{-}A\text{-}R^{41} \quad (40)$$

where in general formula (40), $R^{40}$ and $R^{41}$ each represent, independently of one another, a hydrogen atom or a monovalent group represented by general formula (40a), and A represents a divalent group represented by chemical formula (A1), (A2), (A3), (A4), (A5), or (A6), and (40a)

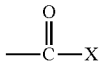

in general formula (40a), X represents a halogen atom (A1)

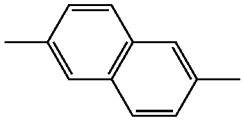

(A2)

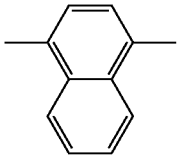

(A3)

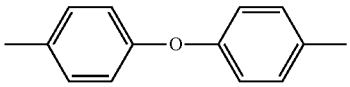

(A4)

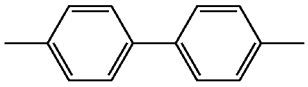

(A5)

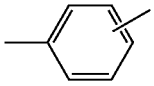

(A6)

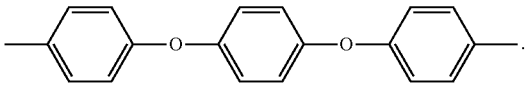

9. The image forming apparatus according to claim 8, wherein the compound represented by general formula (40) is a compound represented by chemical formula (40-1)

(40-1)

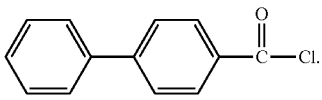

10. The image forming apparatus according to claim 1, wherein the charge generating material is contained in an amount of greater than 0.0% by mass and no greater than 1.0% by mass relative to mass of the single-layer photosensitive layer.

11. The image forming apparatus according to claim 1, further comprising a transfer device configured to transfer a toner image formed on the circumferential surface of the image bearing member to a transfer target, the toner image including the toner, wherein a transfer current of the transfer device is at least −20 μA and no greater than −10 μA.

12. The image forming apparatus according to claim 1, wherein the charger is located in contact with or adjacent to the circumferential surface of the image bearing member.

13. The image forming apparatus according to claim 12, wherein a distance between the charger and the circumferential surface of the image bearing member is no greater than 50 μm.

14. A method for forming an image, comprising:

charging a circumferential surface of an image bearing member to a positive polarity; and collecting a toner remaining on the circumferential surface of the image bearing member through a cleaning member being pressed against the circumferential surface of the image bearing member, wherein a linear pressure N of the cleaning member on the circumferential surface of the image bearing member is at least 14 N/m and no greater than 40 N/m, a rebound resilience R of the cleaning member at a temperature of 25° C. is at least 38%, the leaner pressure N and the rebound resilience R satisfy mathematical formula (1A), the image bearing member includes a conductive substrate and a single-layer photosensitive layer, the single-layer photosensitive layer contains a charge generating material, a hole transport material, an electron transport material, and a binder resin, and the image bearing member satisfies mathematical formula (1B), $$R < 13.771 \times N^{0.4043} \quad (1A)$$

$$0.60 \leqq \frac{V}{(Q/S) \times (d/\varepsilon_r \cdot \varepsilon_0)} \quad (1B)$$

where in mathematical formula (1B),

Q represents a charge amount of the image bearing member,

S represents a charge area of the image bearing member, d represents a film thickness of the single-layer photosensitive layer, $\varepsilon_r$ represents a specific permittivity of the binder resin contained in the single-layer photosensitive layer, $\varepsilon_0$ represents a vacuum permittivity, V is a value calculated in accordance with the following expression: $V=V_0-V_r$, $V_r$ represents a first potential of the circumferential surface of the image bearing member yet to be charged by the charger, and $V_0$ represents a second potential of the circumferential surface of the image bearing member charged by the charger.

* * * * *